US009059499B2

(12) United States Patent
Hotta et al.

(10) Patent No.: US 9,059,499 B2
(45) **Date of Patent: *Jun. 16, 2015**

(54) ANTENNA APPARATUS AND ELECTRONIC DEVICE INCLUDING ANTENNA APPARATUS

(71) Applicant: Kabushiki Kaisha Toshiba, Tokyo (JP)

(72) Inventors: Hiroyuki Hotta, Ome (JP); Koichi Sato, Tachikawa (JP); Ippei Kashiwagi, Fuchu (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 146 days.

This patent is subject to a terminal disclaimer.

(21) Appl. No.: 13/771,484

(22) Filed: Feb. 20, 2013

(65) Prior Publication Data

US 2013/0285870 A1 Oct. 31, 2013

(30) Foreign Application Priority Data

Apr. 26, 2012 (JP) ..... 2012-101759

(51) Int. Cl.

| | |
|---|---|
| ***H01Q 1/38*** | (2006.01) |
| ***H01Q 5/00*** | (2006.01) |
| ***H01Q 1/24*** | (2006.01) |
| ***H01Q 9/42*** | (2006.01) |

(52) U.S. Cl.

CPC ..... *H01Q 5/001* (2013.01); *H01Q 1/243* (2013.01); *H01Q 9/42* (2013.01); *H01Q 5/371* (2015.01)

(58) Field of Classification Search

CPC ..... H01Q 1/243; H01Q 9/42
USPC ..... 343/700, 702, 829, 846
See application file for complete search history.

(56) References Cited

U.S. PATENT DOCUMENTS

| | | | | |
|---|---|---|---|---|
| 6,407,710 | B2 * | 6/2002 | Keilen et al. | 343/702 |
| 6,639,560 | B1 * | 10/2003 | Kadambi et al. | 343/700 MS |
| 6,930,641 | B2 * | 8/2005 | Ohara et al. | 343/702 |
| 7,136,022 | B2 | 11/2006 | Sato et al. | |
| 7,319,432 | B2 * | 1/2008 | Andersson | 343/702 |
| 7,477,199 | B2 | 1/2009 | Hotta et al. | |
| 7,791,546 | B2 | 9/2010 | Hotta et al. | |
| 8,063,827 | B2 * | 11/2011 | Hotta et al. | 343/700 MS |
| 8,098,211 | B2 * | 1/2012 | Onaka et al. | 343/866 |
| 8,717,241 | B2 * | 5/2014 | Shamblin et al. | 343/702 |

FOREIGN PATENT DOCUMENTS

| | | |
|---|---|---|
| JP | 2006-196994 | 7/2006 |
| JP | 2008-177668 | 7/2008 |
| JP | 4643624 | 10/2010 |

* cited by examiner

*Primary Examiner* — Tho G Phan
(74) *Attorney, Agent, or Firm* — Blakely Sokoloff Taylor & Zafman LLP

(57) ABSTRACT

According to one embodiment, an antenna apparatus includes a first antenna element, a second antenna element, and a third antenna element. The first antenna element has one end connected to a feed terminal, and other end open. The second antenna element has one end connected to a first position set on an element of the first antenna element, and other end open, with a portion between one end and the other end being disposed parallel to the first antenna element. The third antenna element has one end connected to a second position set between the other end and the first position on the element of the first antenna element, and other end open, with at least part of a portion between one end and the other end being disposed near the second antenna element.

20 Claims, 30 Drawing Sheets

<Reference example>

<Embodiment>

<Reference example>

<Embodiment>

<Reference example>

<Embodiment>

<Reference example>

<Embodiment>

<Reference example>

<Embodiment>

<Reference example>

<Monopole type>

<Inverted F-type>

<Folded monopole type>

<Modifications of first antenna element>

<Modifications of second antenna element>

<Modifications of second antenna element>
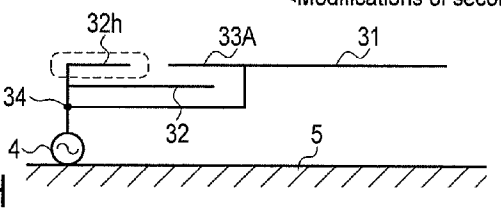
FIG. 56H
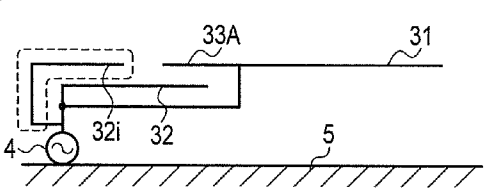
FIG. 56I
FIG. 56J
FIG. 56K
FIG. 56L
FIG. 56M
FIG. 56N
FIG. 56O <Modifications of branch element>

<Modifications of inverted F-type element>

<Modifications of folded monopole element>

<Modifications of folded monopole element>

<Other modifications>

ANTENNA APPARATUS AND ELECTRONIC DEVICE INCLUDING ANTENNA APPARATUS

CROSS-REFERENCE TO RELATED APPLICATIONS

This application is based upon and claims the benefit of priority from Japanese Patent Application No. 2012-101759, filed Apr. 26, 2012, the entire contents of which are incorporated herein by reference.

FIELD

Embodiments described herein relate generally to an antenna apparatus and an electronic device including the antenna apparatus.

BACKGROUND

Recently, the housings of portable terminal devices typified by cellular phones, smartphones, personal digital assistants (PDAs), electronic book readers, and the like have been required to have reduced dimensions and weight from the viewpoint of compactness and lightness. Accordingly, demands have arisen for more compact antenna apparatuses. It has also been required to allow a single portable terminal device to communicate with a plurality of radio systems using different frequency bands.

Under the circumstances, conventionally, for example, a multifrequency antenna apparatus has been proposed, which has the second antenna element formed from a monopole element provided at a position near the feed point of the first antenna element formed from, for example, a folded element with a stub in a direction opposite to the first antenna element. This multifrequency antenna apparatus achieves size reduction of the antenna apparatus by covering a low-frequency band (for example, the 800-MHz band) with the folded element with the stub and also covering a high-frequency band (for example, the 2-GHz band) with the monopole element.

However, further reducing the distance between the folded element and the monopole element to further miniaturize (reduce the height and width) the antenna apparatus will decrease the impedance of the monopole element and make it impossible to obtain satisfactory antenna characteristics.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

FIGS. 56A, 56B, 56C, 56D, 56E, 56F, 56G, 56H, 56I, 56J, 56K, 56L, 56M, 56N, and 56O are views showing a plurality of different modifications of the second antenna element of the antenna apparatus shown in FIG. 1;

DETAILED DESCRIPTION

Various embodiments will be described hereinafter with reference to the accompanying drawings.

In general, according to one embodiment, an antenna apparatus of the embodiment includes a first antenna element, a second antenna element, and a third antenna element. The first antenna element has one end connected to a feed terminal, and other end open, with an element length from one end to the other end being set to substantially ¼ a wavelength corresponding to a preset first resonant frequency. The second antenna element has one end connected to a first position set on an element of the first antenna element, and other end open, with a portion between one end and the other end being disposed parallel to the first antenna element, and an element length from the one end to the other end being set to substantially ¼ a wavelength corresponding to a preset second resonant frequency. The third antenna element has one end connected to a second position set between the other end and the first position on the element of the first antenna element, and other end open, with at least part of a portion between one end and the other end being disposed near the second antenna element.

According to this embodiment, the first current flows from the feed terminal of the second antenna element to the open end during the operation of the apparatus. In contrast to this, the second current opposite in phase to the first current flows from the open end to a feed terminal 4. In addition, since the first antenna element is provided with the third antenna element, the third current having a reverse phase flows from the open end of the third antenna element to the feed terminal via the first antenna element. That is, the third current flows in the first antenna element in addition to the second current. As a consequence, the degree of cancellation between these currents greatly increases at the feed terminal. This makes it possible to increase the resonance impedance of the second antenna element, leading to a decrease in the resonant frequency of the second antenna element.

That is, it is possible to provide an antenna apparatus which can improve the resonance impedance characteristic of the antenna element covering the high-frequency band and lower the resonant band, thereby achieving further miniaturization of the antenna apparatus, and an electronic device including the antenna apparatus.

First Embodiment

Figure 1:
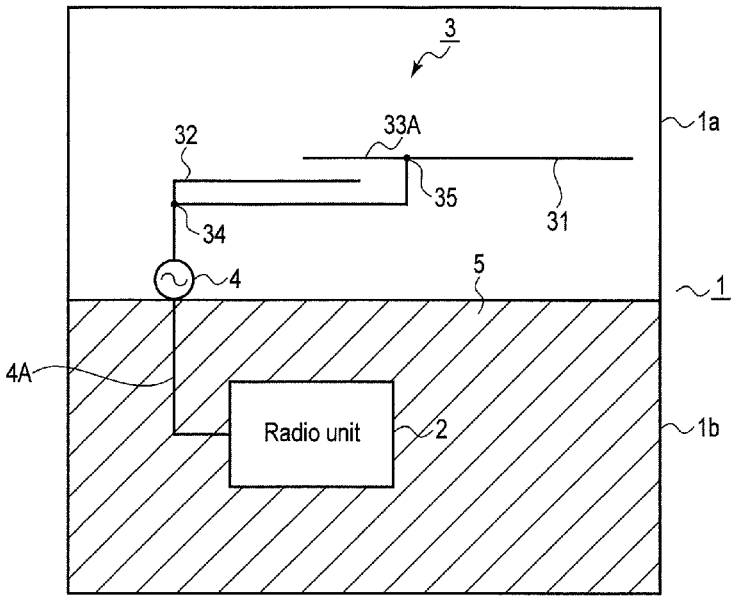
FIG. 1 is a view showing the arrangement of an electronic device including an antenna apparatus according to the first embodiment.

FIG. 1 is a view showing the arrangement of the main part of an electronic device including an antenna apparatus according to the first embodiment. This electronic device is formed from a notebook personal computer or touch panel type portable information terminal including a radio interface, and includes a printed circuit board 1. Note that the electronic device may be another portable terminal device such as a cellular phone, smartphone, PDA (Personal Digital Assistant), electronic book, or game terminal instead of a portable information terminal such as a notebook personal computer or touch panel type portable information terminal. The printed circuit board 1 may serve as part of a metal housing or formed from a metal member such as a copper foil.

The printed circuit board 1 has a first area 1*a* and a second area 1*b*. The first area 1*a* is provided with an antenna apparatus 3. A ground pattern 5 is formed in the second area 1*b*. Note that a plurality of circuit modules necessary to form the electronic device are amounted on the rear surface side of the printed circuit board 1. The circuit modules include a radio unit 2. The radio unit 2 has a function of transmitting and receiving radio signals by using the channel frequency assigned to a radio system as a communication target. The first area 1*a* is also provided with a feed terminal 4. The radio unit 2 is connected to the feed terminal 4 via a feed pattern or a feed cable 4A.

The antenna apparatus 3 has the following arrangement.

That is, the antenna apparatus 3 includes a first antenna element 31 formed from a monopole element, a second antenna element 32 formed from a monopole element, and a branch element 33A serving as the third antenna element.

The first antenna element 31 is folded into a crank shape and has one end connected to the feed terminal 4, and the other end open. The element length of the first antenna element 31 is set to ¼ a wavelength corresponding to a preset first resonant frequency f1. The first resonant frequency f1 is set to, for example, a band (700 to 900 MHz) used by a radio system using LTE (Long Term Evolution).

The second antenna element 32 is folded into an L shape and has one end connected to a first folding point (to be referred to as a parallel connection point hereinafter) 34 of the first antenna element 31, and the other end open. The second antenna element 32 is disposed such that a portion parallel to a side of the ground pattern 5 becomes parallel to the first antenna element 31. The element length of the second antenna element 32 is set to ¼ a wavelength corresponding to a preset second resonant frequency f2. The second resonant frequency f2 is set to, for example, a band (1.7 to 1.9 GHz) used by a radio system conforming to the 3G standard.

The branch element 33A is formed from a linear element and has one end portion connected to a second folding point (to be referred to as a branching point hereinafter) 35 of the first antenna element 31, and the other end open. The branch element 33A is disposed such that its distal end portion is located near and faces the distal end portion of the second antenna element 32.

Figure 2:
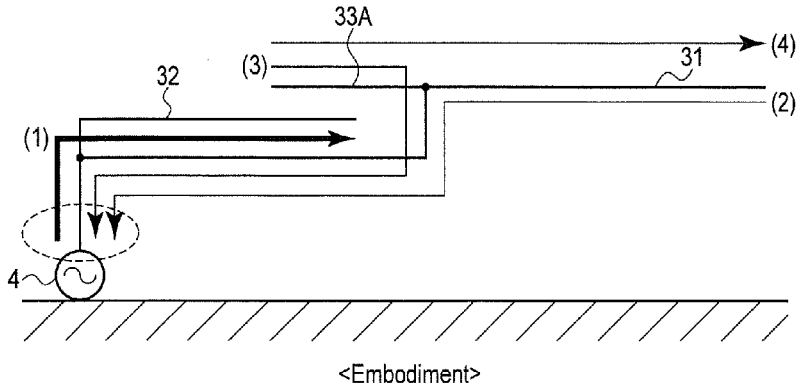
FIG. 2 is a view for explaining the operation of the antenna apparatus shown in FIG. 1.

With this arrangement, when the antenna apparatus operates in the band of the second resonant frequency f2, the following currents flow in the antenna elements 31 to 33A during the operation of the antenna apparatus. FIG. 2 shows an example of how the currents flow. That is, a current (1) flows in the second antenna element 32 from the feed terminal 4 to the open end. In contrast to this, a current (2) opposite in phase to the current (1) flows in the first antenna element 31 from the open end to the feed terminal 4. Furthermore, providing the branch element 33A for the first antenna element 31 makes a current (3) having a reverse phase flow in the first antenna element 31 from the open end of the branch element 33A to the feed terminal 4 via the first antenna element 31.

That is, in addition to the current (2), the current (3) flows in the first antenna element 31. This increases the degree of cancellation between currents at the feed terminal 4. This can increase the resonance impedance in the second antenna element 32. As a consequence, the resonant frequency of the second antenna element 32 can be decreased.

Figure 3:
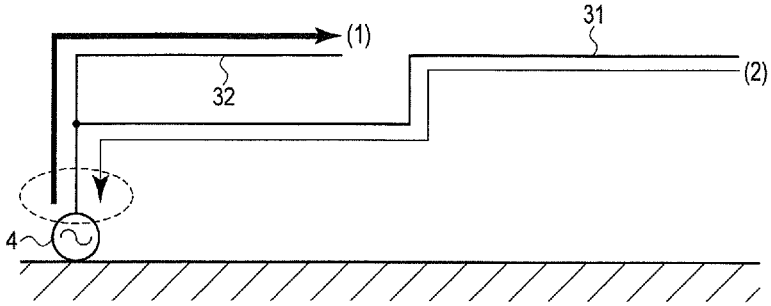
FIG. 3 is a view for explaining the operation of the antenna apparatus shown as a reference example.

Consider a case without the branch element 33A as a reference example. As shown in FIG. 3, although the current (2) opposite in phase to the current (1) flowing in the second antenna element 32 flows in the first antenna element 31, the current (3) does not flow in the branch element 33A. For this reason, the degree of cancellation of the current (1) decreases as compared with the case shown in FIG. 2. As a result, the resonance impedance of the second antenna element 32 decreases.

Example 1

Figure 4:
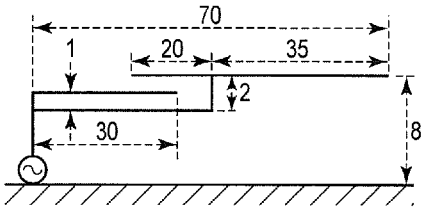
FIG. 4 is a view showing an example of the antenna apparatus shown in FIG. 1.
Figure 5:
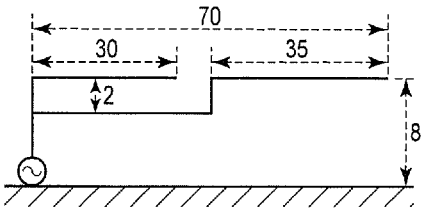
FIG. 5 is a view showing a reference example to be compared with the antenna apparatus shown in FIG. 4.

FIG. 4 shows an example of the antenna apparatus configured such that the resonant frequency band of the first antenna element 31 is set to 700 to 900 MHz, and the resonant frequency band of the second antenna element 32 is set to 1.7 to 1.9 GHz. Referring to FIG. 4, the numbers show the dimensions (unit: mm) of the respective antenna element portions. FIG. 5 shows an arrangement without the branch element 33A as a reference example.

Figure 6:
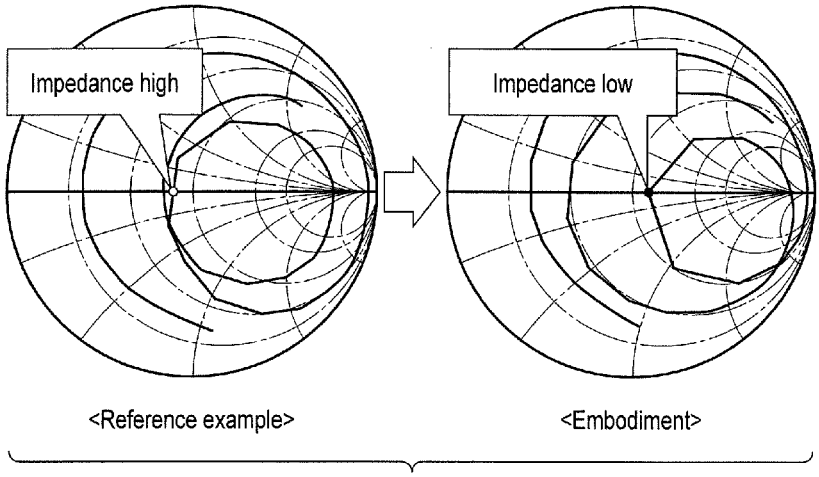
FIG. 6 is a Smith chart showing the antenna characteristics of the embodiment shown in FIG. 4 in comparison with those of the reference example shown in FIG. 5.

FIG. 6 is a Smith chart showing the antenna characteristics of the example shown in FIG. 4 in comparison with those of the reference example shown in FIG. 5. As is obvious from FIG. 6, according to the example of the first embodiment, providing the branch element 33A and disposing the open end portion of the branch element 33A near a second antenna element 62 can increase the impedance at the resonant frequency of the second antenna element 32 as compared with the reference example.

Figure 7:
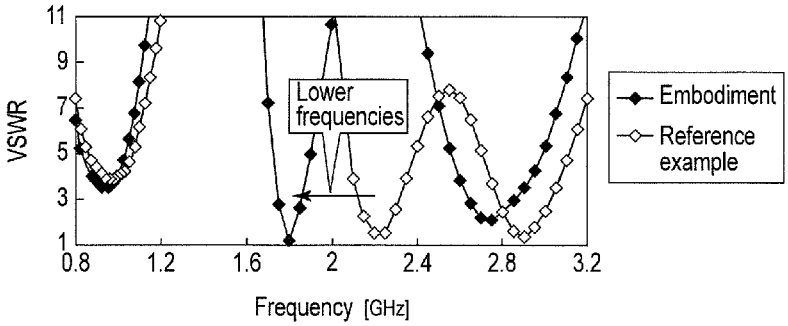
FIG. 7 is a graph showing the VSWR frequency characteristic of the embodiment shown in FIG. 4 in comparison with that of the reference example shown in FIG. 5.

FIG. 7 shows the VSWR frequency characteristic of an example shown in FIG. 4 in comparison with that of the reference example shown in FIG. 5. As is obvious from FIG. 7, according to the example of the first embodiment, it is possible to lower the resonant frequency band of the second antenna element 32 as compared with the reference example. Decreasing the resonant frequency in this manner can further shorten the element length of the second antenna element 32 and achieve further miniaturization of the antenna apparatus.

Second Embodiment

Figure 8:
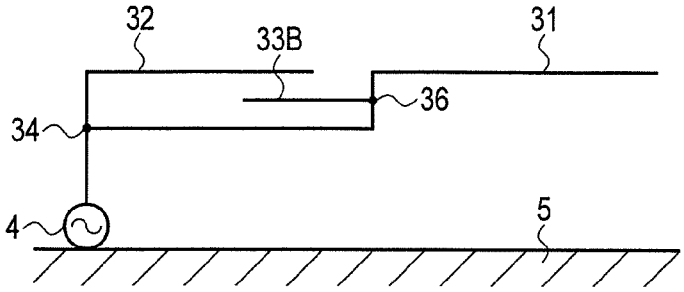
FIG. 8 is a view showing the arrangement of an antenna apparatus according to the second embodiment.

FIG. 8 shows the arrangement of an antenna apparatus according to the second embodiment. Note that the same reference numbers as in FIG. 8 denote the same parts in FIG. 1, and a detailed description of them will be omitted.

Referring to FIG. 8, a branch element 33B branches off from a branching point 36 provided on the vertical portion of a first antenna element 31. The open end portion of the branch element 33B is disposed between the first antenna element 31 and a second antenna element 32 so as to face and be close to them.

Example 1

Figure 9:
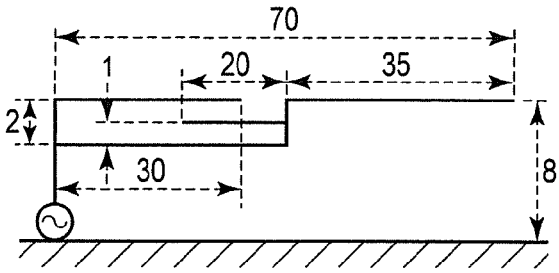
FIG. 9 is a view showing an example of the antenna apparatus shown in FIG. 8.
Figure 10:
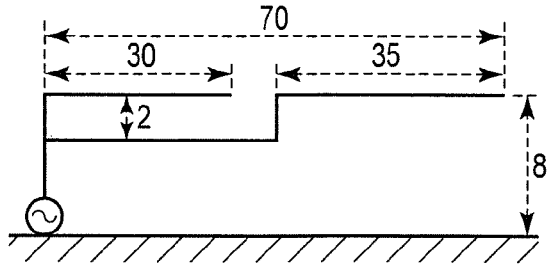
FIG. 10 is a view showing a reference example to be compared with the antenna apparatus shown in FIG. 9.

FIG. 9 shows an example of an antenna apparatus configured such that the resonant frequency band of the first antenna element 31 is set to 700 to 900 MHz, and the resonant frequency band of the second antenna element 32 is set to 1.7 to 1.9 GHz. Referring to FIG. 9, the numbers show the dimensions (unit: mm) of the respective antenna element portions. FIG. 10 shows an arrangement without the branch element 33B as a reference example.

Figure 11:
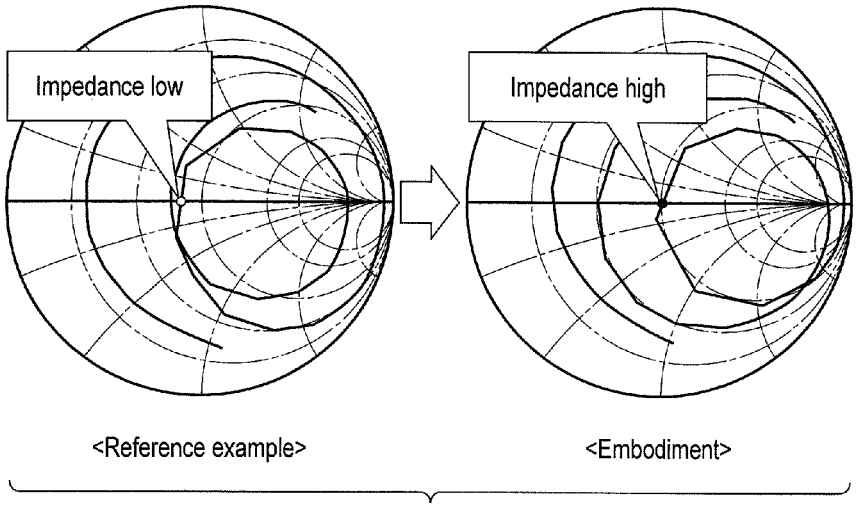
FIG. 11 is a Smith chart showing the antenna characteristics of the embodiment shown in FIG. 9 and those of the reference example shown in FIG. 10.

FIG. 11 is a Smith chart showing the antenna characteristics of the example shown in FIG. 9 in comparison with those of the reference example shown in FIG. 10. As is obvious from FIG. 11, according to Example 1 of the second embodiment, it is possible to increase the impedance at the resonant frequency of the second antenna element 32 as compared with the reference example.

Figure 12:
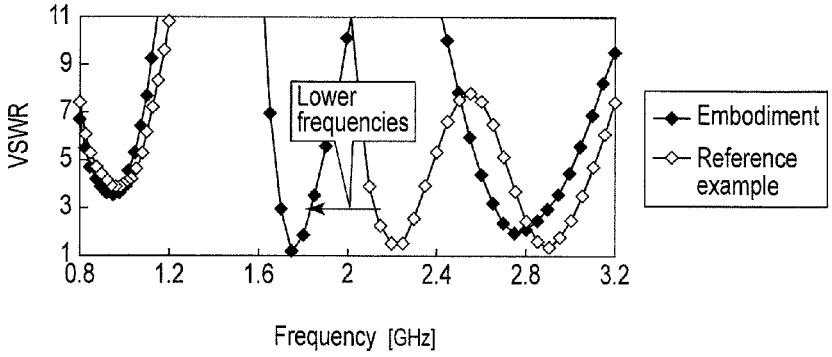
FIG. 12 is a graph showing the VSWR frequency characteristic of the embodiment shown in FIG. 9 in comparison with that of the reference example shown in FIG. 10.

FIG. 12 shows the VSWR frequency characteristic of Example 1 shown in FIG. 9 in comparison with that of the reference example shown in FIG. 10. As is obvious from FIG. 12, according to Example 1 of the second embodiment, it is possible to lower the resonant frequency band of the second antenna element 32. This can further shorten the element length of the second antenna element 32 and achieve further miniaturization of the antenna apparatus.

Example 2

In the antenna apparatuses according to the first and second embodiments, it is possible to variably change the resonant frequencies of the second antenna elements 32 by variably setting the lengths of the portions of the branch elements 33A and 33B which face the second antenna elements 32.

Figure 13:
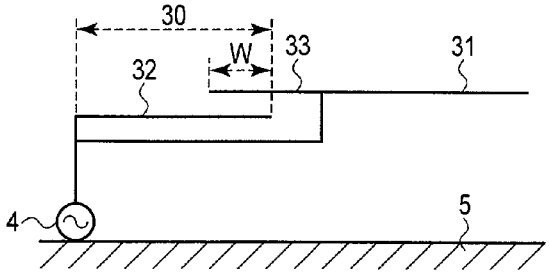
FIG. 13 is a view for explaining an example of the embodiment shown in FIG. 4.
Figure 14:
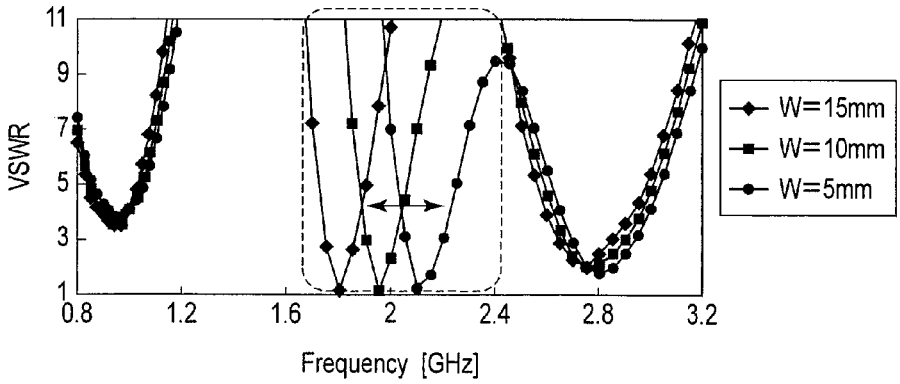
FIG. 14 is a graph showing the VSWR frequency characteristic of the example shown in FIG. 13.

FIG. 13 shows Example 2 of the first embodiment. Referring to FIG. 13, assume that a length W of the portion of the branch element 33A which faces the second antenna element 32 is set to three different values, for example, W=15 mm, W=10 mm, and W=5 mm. In this case, when VSWR frequency characteristics are measured, the results shown in FIG. 14 are obtained. As is obvious from these measurement results, as the length W of the parallel portion increases, it is possible to shift the resonant frequency of the second antenna element 32 to a lower value.

Note that it is possible to variably setting the resonant frequency of the second antenna element 32 by variably changing the length W of the portion of the branch element 33B which is parallel to the second antenna element 32 in the same manner as described above in the second embodiment.

Third Embodiment

Figure 15:
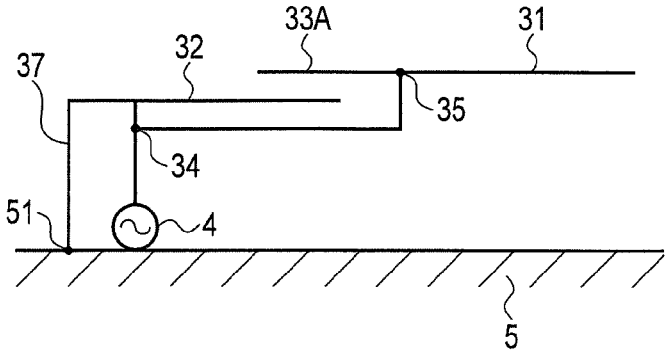
FIG. 15 is a view showing the arrangement of an antenna apparatus according to the third embodiment.

FIG. 15 shows the arrangement of an antenna apparatus according to the third embodiment. Note that the same reference numbers as in FIG. 15 denote the same parts in FIG. 1, and a detailed description of them will be omitted.

Referring to FIG. 15, a shorting element 37 is connected in parallel to a first antenna element 31. The shorting element 37 has an L shape, with one end being connected to a ground terminal 51 and the other end being connected to a parallel connection point 34 or its nearby position. The shorting element 37 is disposed parallel to the portion between a feed terminal 4 of the first antenna element 31 and the parallel connection point 34. That is, the first antenna element 31 and the shorting element 37 constitute an inverted F-type antenna element. Note that a branch element 33A is connected to a branching point 35 provided in the middle of the first antenna element 31 as in the first embodiment.

Example 1

Figure 16:
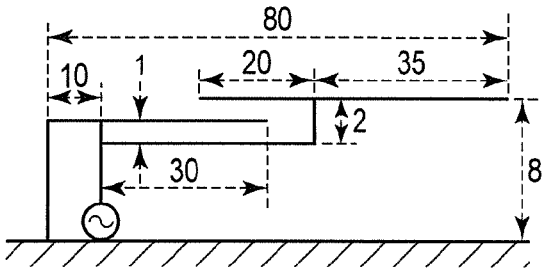
FIG. 16 is a view showing an example of the antenna apparatus shown in FIG. 15.
Figure 17:
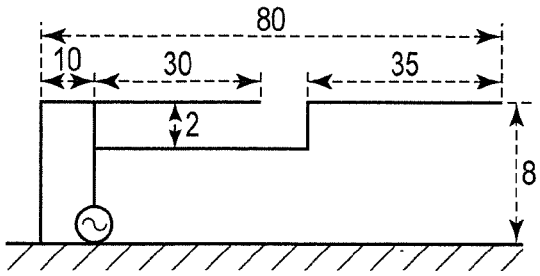
FIG. 17 is a view showing a reference example to be compared with the antenna apparatus shown in FIG. 16.

FIG. 16 shows an example of the antenna apparatus configured such that the resonant frequency band of the first antenna element 31 is set to 700 to 900 MHz, and the resonant frequency band of a second antenna element 32 is set to 1.7 to 1.9 GHz. Referring to FIG. 16, the numbers show the dimensions (unit: mm) of the respective antenna element portions. FIG. 17 shows an arrangement without the branch element 33A as a reference example.

Figure 18:
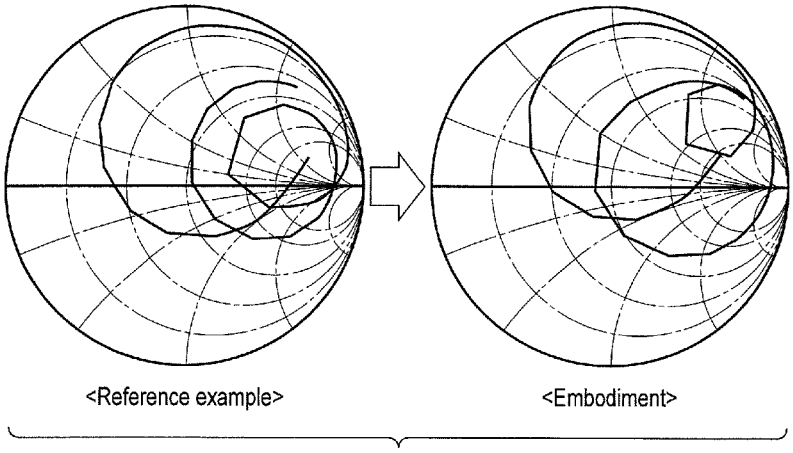
FIG. 18 is a Smith chart showing the antenna characteristics of the embodiment shown in FIG. 16 in comparison with those of the reference example shown in FIG. 17.

FIG. 18 is a Smith chart showing the antenna characteristics of the example shown in FIG. 16 in comparison with those of the reference example shown in FIG. 17. As is obvious from FIG. 17, according to Example 1 of the third embodiment, it is possible to increase the impedance at the resonant frequency of the second antenna element 32 as compared with the reference example as in the first embodiment described above.

Figure 19:
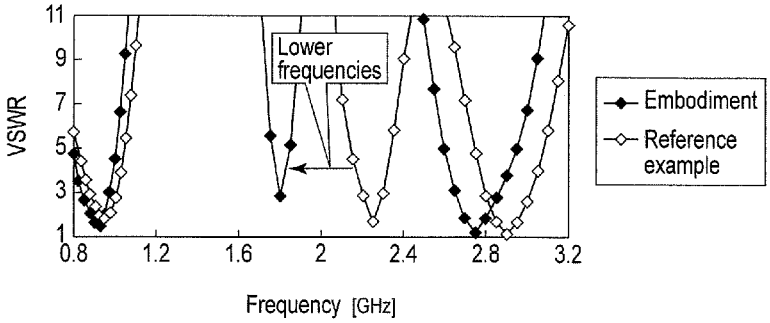
FIG. 19 is a graph showing the VSWR frequency characteristic of the embodiment shown in FIG. 16 in comparison with that of the reference example shown in FIG. 17.

FIG. 19 shows the VSWR frequency characteristic of Example 1 shown in FIG. 16 in comparison with that of the reference example shown in FIG. 17. As is obvious from FIG. 19, according to Example 1 of the third embodiment, it is possible to lower the resonant frequency band of the second antenna element 32. This can further shorten the element length of the second antenna element 32 and achieve further miniaturization of the antenna apparatus.

Fourth Embodiment

Figure 20:
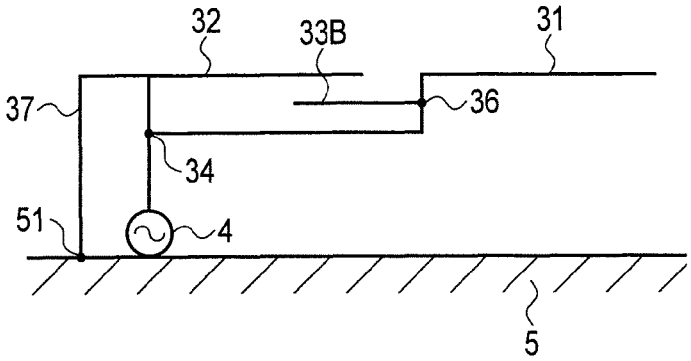
FIG. 20 is a view showing the arrangement of an antenna apparatus according to the four embodiment.

FIG. 20 shows the arrangement of an antenna apparatus according to the fourth embodiment. Note that the same reference numbers as in FIG. 20 denote the same parts in FIG. 15, and a detailed description of them will be omitted.

Referring to FIG. 20, a branch element 33B branches off from a branching point 36 provided on the vertical portion of a first antenna element 31. The open end portion of the branch element 33B is disposed parallel between the first antenna element 31 and the second antenna element 32.

Example 1

Figure 21:
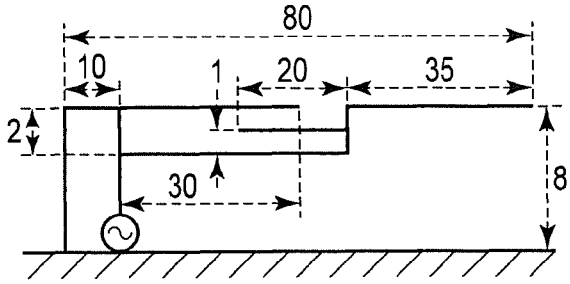
FIG. 21 is a view showing an example of the antenna apparatus shown in FIG. 20.
Figure 22:
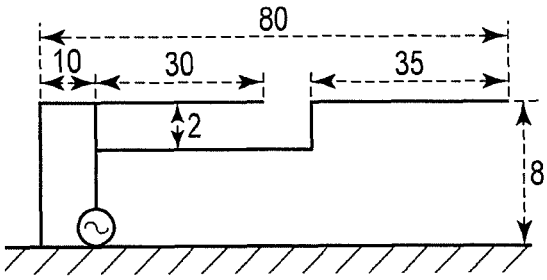
FIG. 22 is a view showing a reference example to be compared with the antenna apparatus shown in FIG. 21.

FIG. 21 shows an example of the antenna apparatus configured such that the resonant frequency band of the first antenna element 31 is set to 700 to 900 MHz, and the resonant frequency band of the second antenna element 32 is set to 1.7 to 1.9 GHz. Referring to FIG. 21, the numbers show the dimensions (unit: mm) of the respective antenna element portions. FIG. 22 shows an arrangement without the branch element 33B as a reference example.

Figure 23:
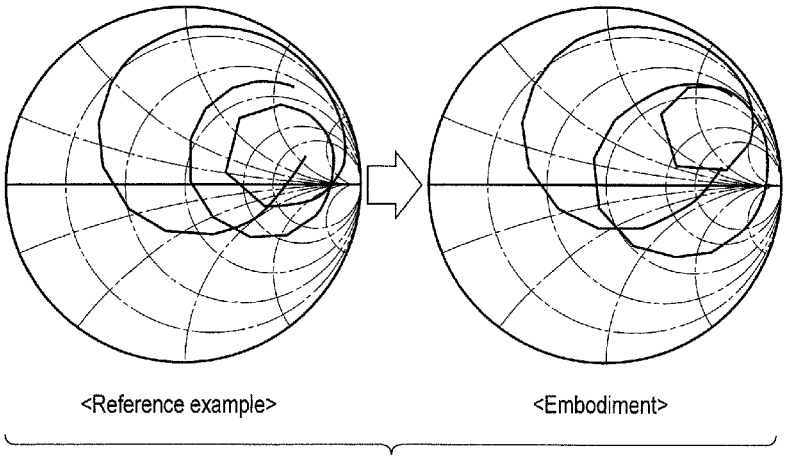
FIG. 23 is a Smith chart showing the antenna characteristics of the embodiment shown in FIG. 21 in comparison with those of the reference example shown in FIG. 22.

FIG. 23 is a Smith chart showing the antenna characteristics of Example 1 shown in FIG. 21 in comparison with those of the reference example shown in FIG. 22. As is obvious from FIG. 23, according to Example 1 of the fourth embodiment, it is possible to increase the impedance at the resonant frequency of the second antenna element 32 as compared with the reference example as in the third embodiment.

Figure 24:
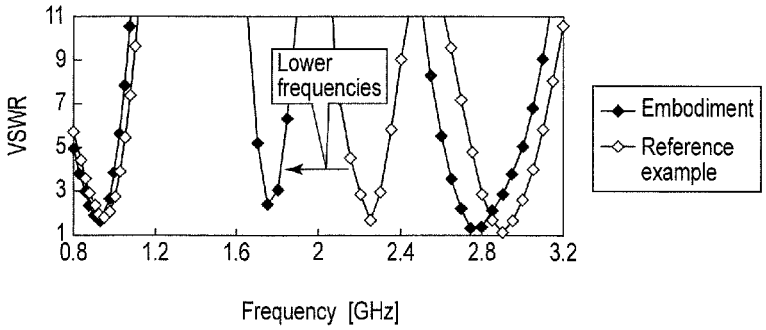
FIG. 24 is a view showing the VSWR frequency characteristic of the embodiment shown in FIG. 21 in comparison with that of the reference example shown in FIG. 22.

FIG. 24 shows the VSWR frequency characteristic of the example shown in FIG. 21 in comparison with that of the reference example shown in FIG. 22. As is obvious from FIG. 24, according to Example 1 of the fourth embodiment, it is possible to lower the resonant frequency band of the second antenna element 32. This can further shorten the element length of the second antenna element 32 and achieve further miniaturization of the antenna apparatus.

Example 2

In the antenna apparatuses according to the third and fourth embodiments, it is possible to variably change the resonant frequencies of the second antenna elements 32 by variably setting the lengths of the portions of the branch elements 33A and 33B which face the second antenna elements 32.

Figure 25:
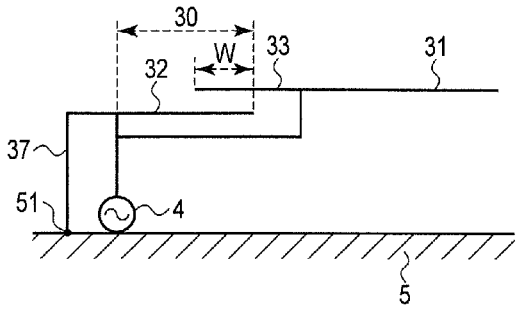
FIG. 25 is a view for explaining an example of the embodiment shown in FIG. 15.
Figure 26:
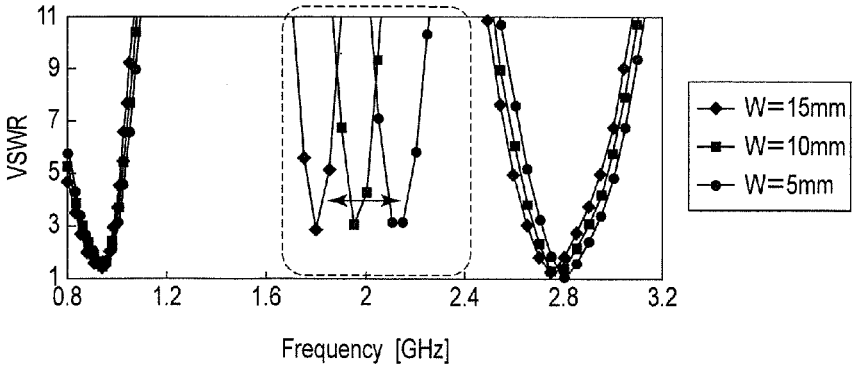
FIG. 26 is a graph showing the VSWR frequency characteristic of the example shown in FIG. 25.

FIG. 25 shows Example 2 of the third embodiment. Referring to FIG. 25, assume that a length W of the portion of the branch element 33A which faces the second antenna element 32 is set to three different values, for example, W=15 mm, W=10 mm, and W=5 mm. In this case, when VSWR frequency characteristics are measured, the results shown in FIG. 26 are obtained. As is obvious from these measurement results, as the length W of the parallel portion increases, it is possible to shift the resonant frequency of the second antenna element 32 to a lower value.

Note that it is possible to variably setting the resonant frequency of the second antenna element 32 by variably changing the length W of the portion of the branch element 33B which is parallel to the second antenna element 32 in the same manner as described above in the fourth embodiment.

Fifth Embodiment

Figure 27:
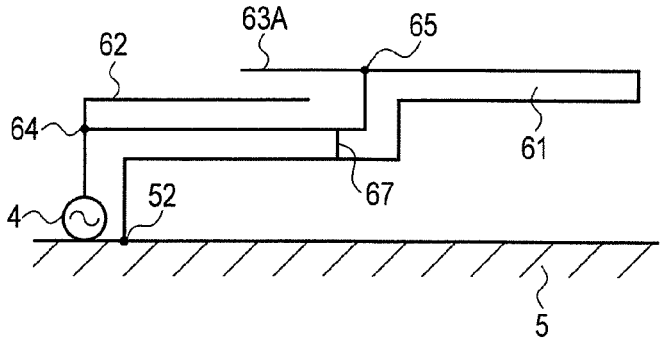
FIG. 27 is a view showing the arrangement of an antenna apparatus according to the fifth embodiment.

FIG. 27 is a view showing the arrangement of an antenna apparatus according to the fifth embodiment.

This antenna apparatus includes a first antenna element 61 formed from a folded monopole element with a stub, a second antenna element 62 formed from a monopole element, and a branch element 63A.

The first antenna element 61 is formed by folding a linear element into a hairpin shape at a position dividing the entire element into almost two equal portions and further folding a midway portion of the element, folded into the hairpin shape, into a crank shape. One end of the first antenna element 61 is connected to a feed terminal 4 described above, and the other end is connected to a ground terminal 52. A stub 67 is provided between the forward and backward portions formed by the above folding operation. The element length of the first antenna element 61 is set such that the electrical length from the feed terminal 4 to the ground terminal 52 through the folding end becomes nearly ½ a wavelength corresponding to a preset first resonant frequency f1. The distance between the feed terminal 4 and the ground terminal 52 is set to ⅕ or less a wavelength corresponding to the first resonant frequency f1. Note that the first resonant frequency f1 is set to, for example, a band (700 to 900 MHz) used by a radio system using LTE.

The second antenna element 62 is formed into an L shape and has one end connected to a first folding point (to be referred to as a parallel connection point hereinafter) 64 of the first antenna element 61 which is located near the feed terminal 4, and the other end open. The second antenna element 62 is disposed such that a portion parallel to a side of a ground pattern 5 becomes parallel to the first antenna element 61. The element length of the second antenna element 62 is set to ¼ a wavelength corresponding to a preset second resonant frequency f2. The second resonant frequency f2 is set to, for example, a band (1.7 to 1.9 GHz) used by a radio system conforming to the 3G standard.

The branch element 63A is formed from a linear element and has one end connected to a second folding point (to be referred to as a branching point hereinafter) 65 provided at a position on the first antenna element 61 which is sufficiently spaced away from the parallel connection point 64, and the other end open. A portion of the branch element 63A which extends from the open end by a predetermined length is disposed so as to be close to and face a portion of the second antenna element 62 which extends from the open end by a predetermined length.

Example 1

Figure 28:
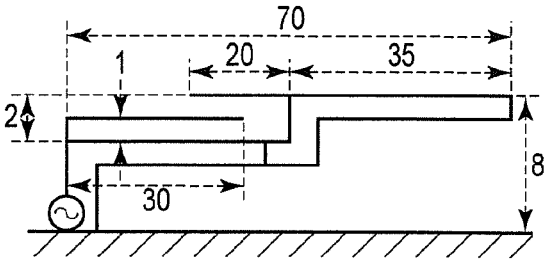
FIG. 28 is a view showing an example of the antenna apparatus shown in FIG. 27.
Figure 29:
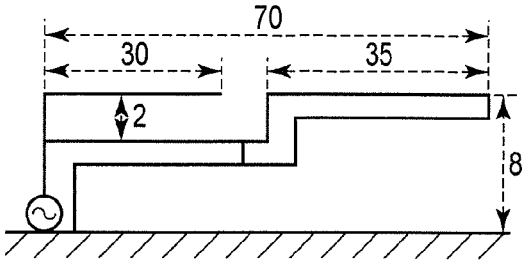
FIG. 29 is a view showing a reference example to be compared with the antenna apparatus shown in FIG. 28.

FIG. 28 shows an example of the antenna apparatus configured such that the resonant frequency band of the first antenna element 61 is set to 700 to 900 MHz, and the resonant frequency band of the second antenna element 62 is set to 1.7 to 1.9 GHz. Referring to FIG. 28, the numbers show the dimensions (unit: mm) of the respective antenna element portions. FIG. 29 shows an arrangement without the branch element 63A as a reference example.

Figure 30:
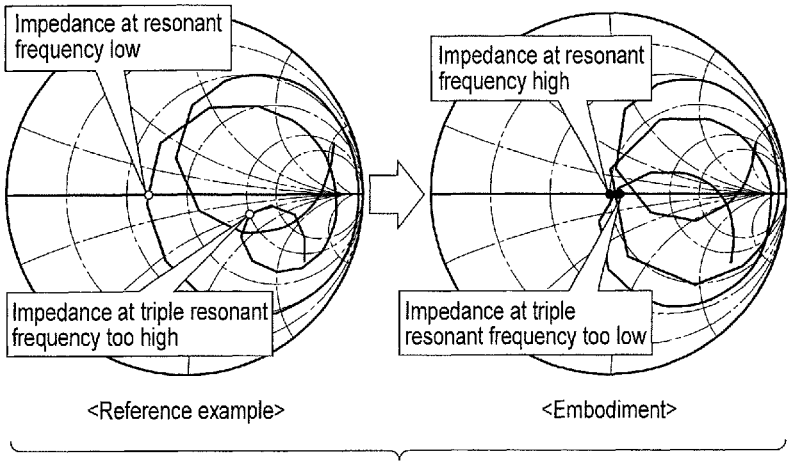
FIG. 30 is a Smith chart showing the antenna characteristics of the embodiment shown in FIG. 21 in comparison with those of the reference example shown in FIG. 22.

FIG. 30 is a Smith chart showing the antenna characteristics of the example shown in FIG. 28 in comparison with those of the reference example shown in FIG. 29. As is obvious from FIG. 30, according to Example 1 of the fifth embodiment, it is possible to increase the impedance at the resonant frequency of the second antenna element 62 as compared with the reference example by providing the branch element 63A and disposing the portion extending from the open end by the predetermined length at a position near the second antenna element 62. It is also possible to decrease the impedance at the triple resonant frequency of the first antenna element 61 as compared with the reference example.

Figure 31:
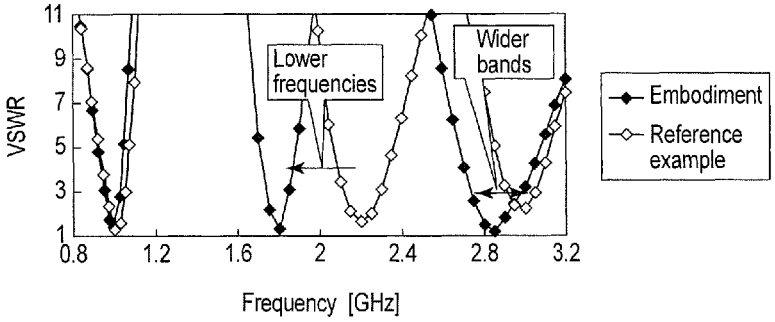
FIG. 31 is a graph showing the VSWR frequency characteristic of the embodiment shown in FIG. 21 in comparison with that of the reference example shown in FIG. 22.

FIG. 31 shows the VSWR frequency characteristic of Example 1 shown in FIG. 28 in comparison with that of the reference example shown in FIG. 29. As is obvious from FIG. 31, according to Example 1 of the fifth embodiment, it is possible to lower the resonant frequency band of the second antenna element 62. This can further shorten the element length of the second antenna element 62 and achieve further miniaturization of the antenna apparatus. In addition, it is possible to increase the width of the 2.8-GHz resonant band as the triple resonant frequency band of the first antenna element 61.

Sixth Embodiment

Figure 32:
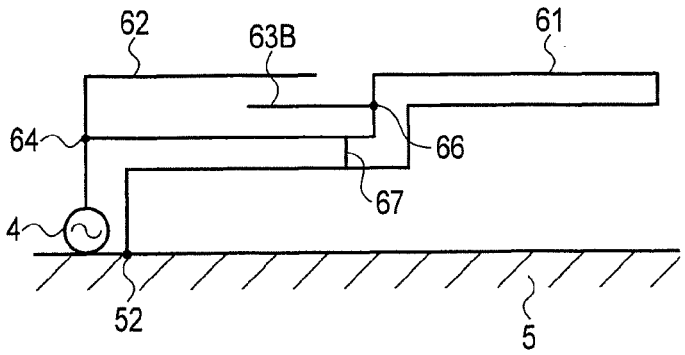
FIG. 32 is a view showing the arrangement of an antenna apparatus according to the sixth embodiment.

FIG. 32 shows the arrangement of an antenna apparatus according to the sixth embodiment. Note that the same reference numbers as in FIG. 32 denote the same parts in FIG. 1, and a detailed description of them will be omitted.

Referring to FIG. 32, a branch element 63B branches off from a branching point 66 provided on the vertical portion of a first antenna element 61. The branch element 63B is disposed between the first antenna element 61 and a second antenna element 62. A portion of the branch element 63B which extends from the open end by a predetermined length is disposed so as to be close to and face a portion of the second antenna element 62 which extends from the open end by a predetermined length.

Example 1

Figure 33:
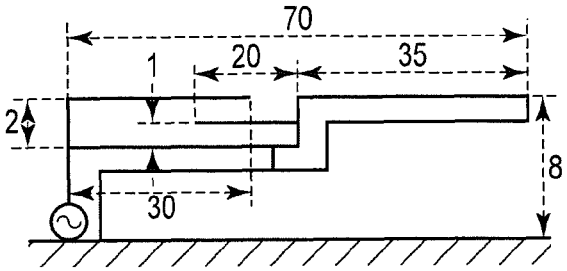
FIG. 33 is a view showing an example of the antenna apparatus shown in FIG. 32.
Figure 34:
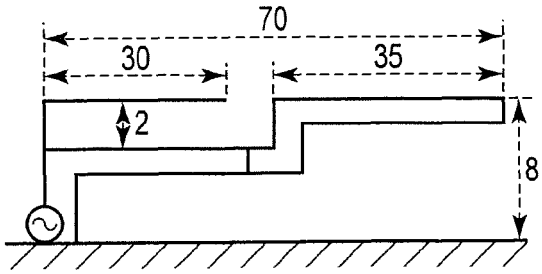
FIG. 34 is a view showing a reference example to be compared with the antenna apparatus shown in FIG. 33.

FIG. 33 shows an example of the antenna apparatus configured such that the resonant frequency band of the first antenna element 61 is set to 700 to 900 MHz, and the resonant frequency band of the second antenna element 62 is set to 1.7 to 1.9 GHz. Referring to FIG. 33, the numbers show the dimensions (unit: mm) of the respective antenna element portions. FIG. 34 shows an arrangement without the branch element 63B as a reference example.

Figure 35:
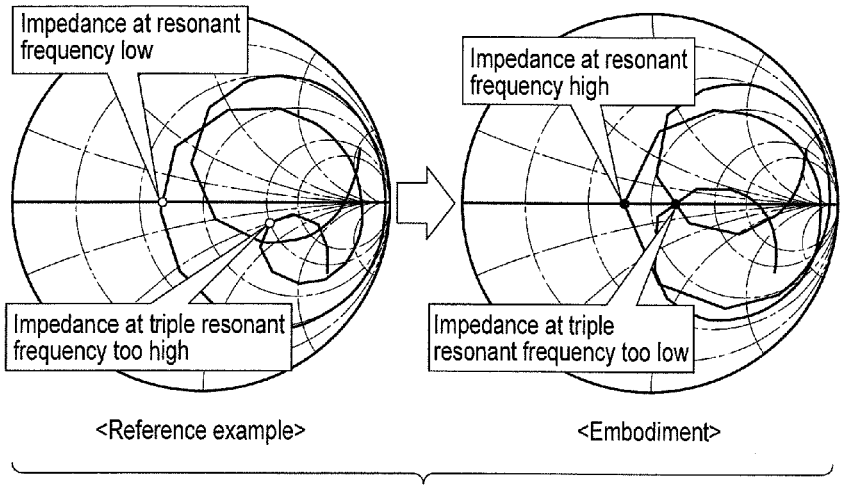
FIG. 35 is a Smith chart showing the antenna characteristics of the embodiment shown in FIG. 33 in comparison with those of the reference example shown in FIG. 34.

FIG. 35 is a Smith chart showing the antenna characteristics of Example 1 shown in FIG. 33 in comparison with those of the reference example shown in FIG. 34. As is obvious from FIG. 35, according to Example 1 of the sixth embodiment, it is possible to increase the impedance at the resonant frequency of the second antenna element 62 as compared with the reference example as in the fifth embodiment described above. It is also possible to decrease the impedance at the triple resonant frequency of the first antenna element 61 as compared with the reference example.

Figure 36:
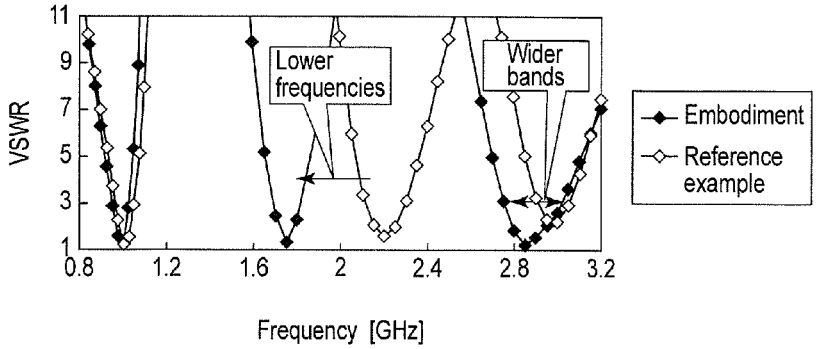
FIG. 36 is a graph showing the VSWR frequency characteristic of the embodiment shown in FIG. 33 in comparison with that of the reference example shown in FIG. 34.

FIG. 36 shows the VSWR frequency characteristic of Example 1 shown in FIG. 33 in comparison with that of the reference example shown in FIG. 34. As is obvious from FIG. 36, according to Example 1 of the sixth embodiment, it is possible to lower the resonant frequency band of the second antenna element 62. This can further shorten the element length of the second antenna element 62 and achieve further miniaturization of the antenna apparatus. In addition, it is possible to increase the width of the 2.8-GHz resonant band as the triple resonant frequency band of the first antenna element 61.

Example 2

In the antenna apparatuses according to the fifth and sixth embodiments, it is possible to variably change the resonant frequencies of the second antenna elements 62 by variably setting the lengths of the portions of the branch elements 63A and 63B which face the second antenna elements 62.

Figure 37:
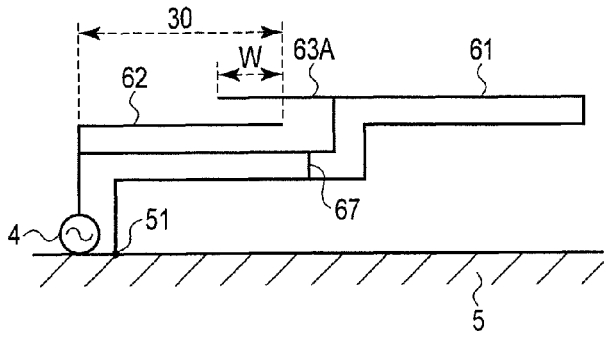
FIG. 37 is a view for explaining an example of the embodiment shown in FIG. 32.
Figure 38:
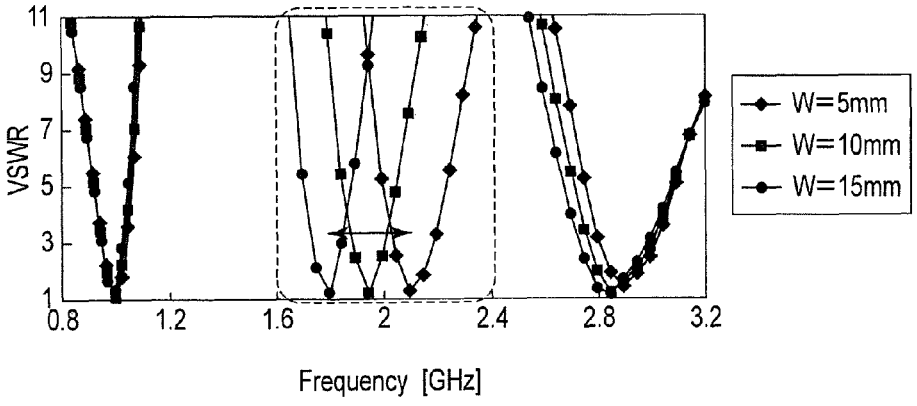
FIG. 38 is a graph showing the VSWR frequency characteristic of the example shown in FIG. 37.

FIG. 37 shows Example 2 of the fifth embodiment. Referring to FIG. 37, assume that a length W of the portion of the branch element 63A which faces the second antenna element 62 is set to three different values, for example, W=15 mm, W=10 mm, and W=5 mm. In this case, when VSWR frequency characteristics are measured, the results shown in FIG. 38 are obtained. As is obvious from these measurement results, as the length W of the parallel portion increases, it is possible to shift the resonant frequency of the second antenna element 62 to a lower value.

Note that it is possible to variably set the resonant frequency of the second antenna element 62 by variably changing the length W of the portion of the branch element 63B which is parallel to the second antenna element 62 in the same manner in the sixth embodiment.

Example 3

Figure 39:
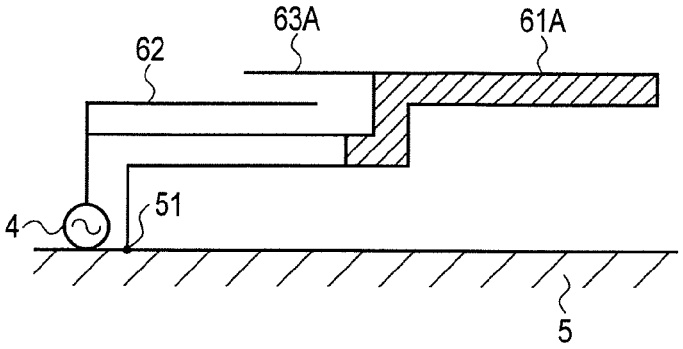
FIG. 39 is a view showing another example of the embodiment shown in FIG. 32.

FIG. 39 shows Example 3 of the antenna apparatus shown in FIG. 27. Note that the same reference numbers as in FIG. 39 denote the same parts in FIG. 27, and a detailed description of them will be omitted.

The section from the installation position of the stub of the first antenna element to the folding end is formed from one plate-like element 61A. The element 61A may be formed into a rod-like shape instead of a plate-like shape. Note that the branch element 63A is provided at an intermediate position of the first antenna element 61A as in the case shown in FIG. 27.

With this arrangement, it is possible to simplify the fabrication of the first antenna element 61A formed from a folded monopole element by using a metal sheet in addition to obtaining the effects of increasing the impedance of the second antenna element 62, decreasing the impedance at the triple resonant frequency of the first antenna element 61, and lowering and expanding the resonant frequency band of the second antenna element 62 as described in the fifth and sixth embodiments. In addition, it is possible to increase the structural strength of the section extending from the stub 67 of the first antenna element 61A to the folding end. This can improve the yield in fabricating antenna apparatuses. In addition, this makes it possible to finely adjust the resonant frequency by cutting a distal end portion of the first antenna element 61A as needed.

Seventh Embodiment

Figure 40:
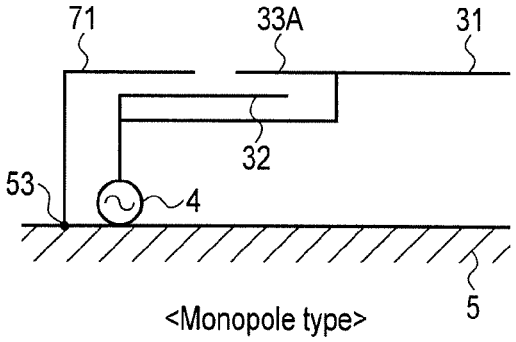
FIG. 40 is a view showing the arrangement of an antenna apparatus (monopole type) according to the seventh embodiment.

FIG. 40 shows the arrangement of an antenna apparatus according to the seventh embodiment. Note that the same reference numbers as in FIG. 40 denote the same parts in FIG. 1, and a detailed description of them will be omitted.

The antenna apparatus according to the seventh embodiment is configured such that a first antenna element 31 is formed from a monopole element, and a parasitic element 71 is provided near a second antenna element 32 so as to be electrostatically coupled to it. One end of the parasitic element 71 is connected to a ground terminal 53, and the other end is connected to a midway position of the first antenna element 31.

Example 1

Figure 41:
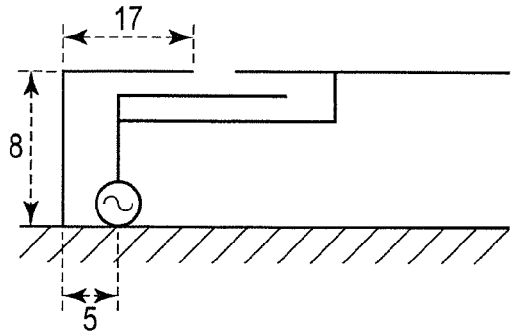
FIG. 41 is a view showing an example of the antenna apparatus shown in FIG. 40.

FIG. 41 shows an example of the antenna apparatus configured such that the resonant frequency band of the first antenna element 31 is set to 700 to 900 MHz used by a radio system using LTE, and the resonant frequency band of a second antenna element 32 is set to 1.7 to 1.9 GHz used by a radio system conforming to the 3G standard. Referring to FIG. 41, the numbers show the dimensions (unit: mm) of the respective antenna element portions.

Figure 42:
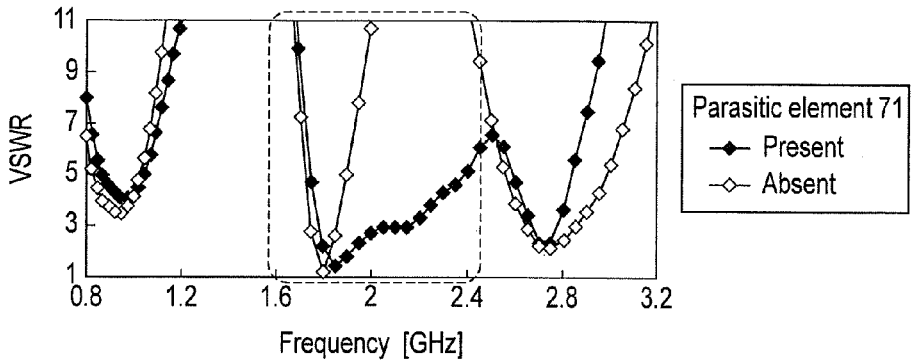
FIG. 42 is a graph showing the VSWR frequency characteristic of the antenna apparatus shown in FIG. 41 in comparison with that of an antenna apparatus without any parasitic element.

FIG. 42 shows the VSWR frequency characteristic of an example shown in FIG. 41 in comparison with that of an antenna apparatus without the parasitic element 71. As is obvious from FIG. 42, according to the example of the seventh embodiment, it is possible to further expand the resonant frequency band of the second antenna element 32 by disposing the parasitic element 71 near the second antenna element 32 so as to allow the parasitic element 71 to be electrostatically coupled to the second antenna element 32.

Eighth Embodiment

Figure 43:
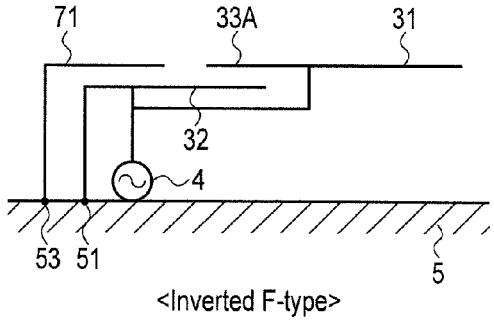
FIG. 43 is a view showing the arrangement of an antenna apparatus (inverted F type) according to the eighth embodiment.

FIG. 43 shows the arrangement of an antenna apparatus according to the eighth embodiment. Note that the same reference numbers as in FIG. 43 denote the same parts in FIG. 15, and a detailed description of them will be omitted.

The antenna apparatus according to the eighth embodiment is configured such that a first antenna element 31 is formed from an inverted F-type antenna element, and a parasitic element 71 is added and provided near a second antenna element 32 so as to allow the parasitic element 71 to be electrostatically coupled to the second antenna element 32.

Example 1

Figure 44:
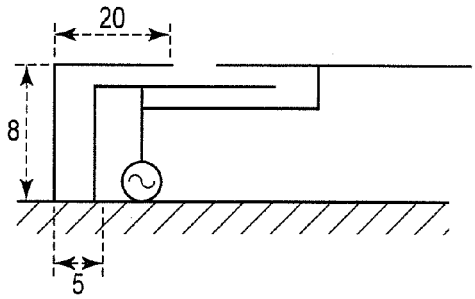
FIG. 44 is a view showing an example of the antenna apparatus shown in FIG. 43.

As in the seventh embodiment, FIG. 44 shows an example of the antenna apparatus configured such that the resonant frequency band of the first antenna element 31 is set to the band (700 to 900 MHz) used by a radio system using LTE, and the resonant frequency band of the second antenna element 32 is set to the band (1.7 to 1.9 GHz) used by a radio system conforming to the 3G standard. Referring to FIG. 44, the numbers show the dimensions (unit: mm) of the respective antenna element portions.

Figure 45:
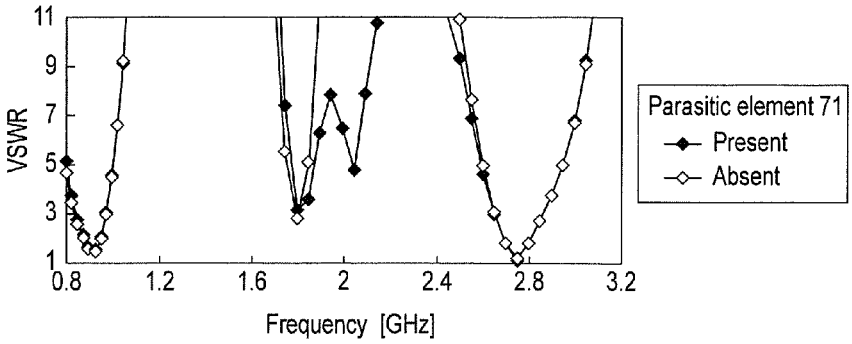
FIG. 45 is a graph showing the VSWR frequency characteristic of the antenna apparatus shown in FIG. 44 in comparison with that of an antenna apparatus without any parasitic element.

FIG. 45 shows the VSWR frequency characteristic of an example shown in FIG. 44 in comparison with that of an antenna apparatus without the parasitic element 71. As is obvious from FIG. 45, in Example 1 of the eighth embodiment, it is possible to further expand the resonant frequency band of the second antenna element 32 by disposing the parasitic element 71 near the second antenna element 32 so as to allow the parasitic element 71 to be electrostatically coupled to the second antenna element 32.

Ninth Embodiment

Figure 46:
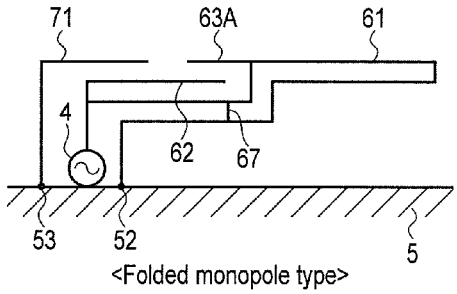
FIG. 46 is a view showing the arrangement of an antenna apparatus (folded type) according to the ninth embodiment.

FIG. 46 shows the arrangement of an antenna apparatus according to the ninth embodiment. Note that the same reference numbers as in FIG. 46 denote the same parts in FIG. 27, and a detailed description of them will be omitted.

The antenna apparatus according to the ninth embodiment is configured such that a first antenna element 61 is formed from a folded monopole antenna with a stub, and a parasitic element 71 is added and provided near a second antenna element 62 so as to allow the parasitic element 71 to be electrostatically coupled to the second antenna element 32.

Example 1

Figure 47:
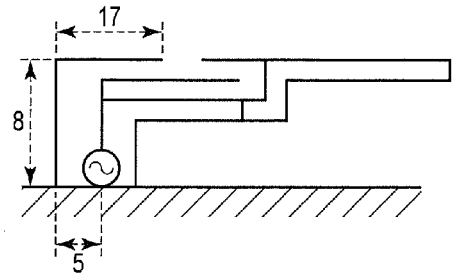
FIG. 47 is a view showing Example 1 of the antenna apparatus shown in FIG. 46.

As in the seventh embodiment, FIG. 47 shows an example of the antenna apparatus configured such that the resonant frequency band of the first antenna element 61 is set to the band (700 to 900 MHz) used by a radio system using LTE, and the resonant frequency band of the second antenna element 62 is set to the band (1.7 to 1.9 GHz) used by a radio system conforming to the 3G standard. Referring to FIG. 47, the numbers show the dimensions (unit: mm) of the respective antenna element portions.

Figure 48:
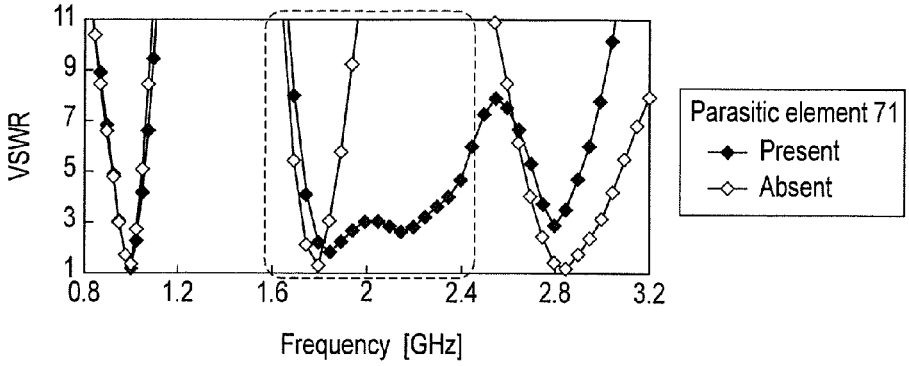
FIG. 48 is a graph showing the VSWR frequency characteristic of the antenna apparatus shown in FIG. 47 in comparison with that of an antenna apparatus without any parasitic element.

FIG. 48 shows the VSWR frequency characteristic of an example shown in FIG. 47 in comparison with that of an antenna apparatus without the parasitic element 71. As is obvious from FIG. 48, in Example 1 of the ninth embodiment, it is possible to further expand the resonant frequency band of the second antenna element 62 by disposing the parasitic element 71 near the second antenna element 62 so as to allow the parasitic element 71 to be electrostatically coupled to the second antenna element 62.

Example 2

Figure 49:
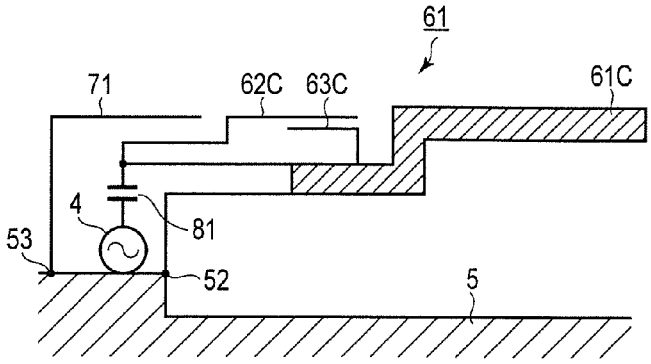
FIG. 49 is a view showing Example 2 of the antenna shown in FIG. 46.

FIG. 49 shows Example 2 of the antenna apparatus according to the ninth embodiment. Note that in the following description, the same reference numbers as in FIG. 49 denote the same parts in FIG. 46.

This antenna apparatus is configured such that a section extending from a stub 67 of the first antenna element 61 to the folding end is formed from one plate-like element 61C, and an L-shaped branch element 63C is connected between the folded portion of the one plate-like element 61*c* and the stub. The second antenna element 62 is folded into a crank shape, with its distal end portion being disposed near the horizontal portion of the branch element 63C. In addition, a side of a ground pattern 5 is formed into a stepped shape, and a feed terminal 4 is disposed on the stepped portion. In addition, ground terminals 52 and 53 are arranged on the two sides of the feed terminal 4. The other end (shorting end) of the first antenna element 61 is connected to the ground terminal 52, of the ground terminals 52 and 53, which are disposed on a corner portion of the stepped portion of the ground pattern 5, and the parasitic element 71 is connected to the ground terminal 53. In addition, a lumped parameter element 81 is connected between the feed terminal 4 and a parallel connection point 64 between the first antenna element 61 and a second antenna element 62C. The lumped parameter element 81 is formed from a chip capacitor (for example, 3 pF).

Figure 50:
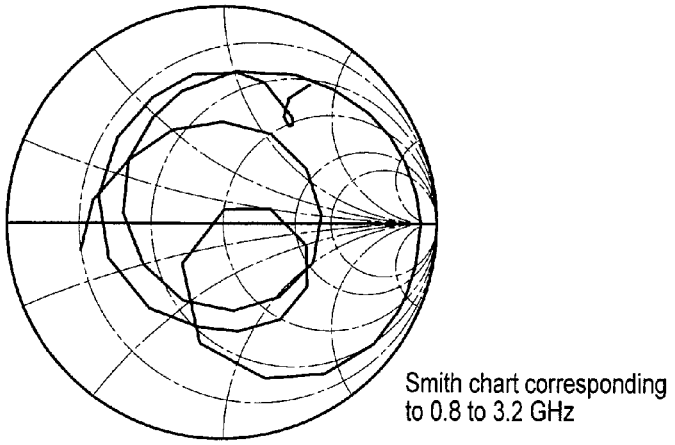
FIG. 50 is a Smith chart showing the antenna characteristics of Example 2 shown in FIG. 49.
Figure 51:
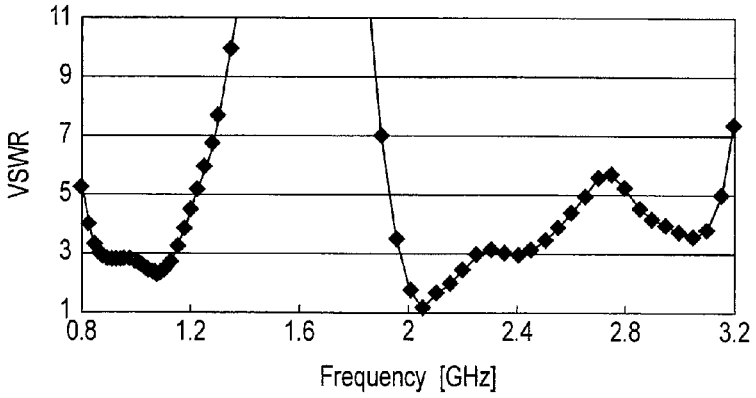
FIG. 51 is a graph showing the VSWR frequency characteristic of Example 2 shown in FIG. 49.

FIG. 50 is a Smith chart showing the antenna characteristics of the antenna apparatus according to Example 2 shown in FIG. 49. FIG. 51 shows the VSWR frequency characteristic of Example 2 shown in FIG. 49. As is obvious from FIGS. 50 and 51, the antenna element shown in FIG. 49 can cover a wide band including a low-frequency band (mainly the 700- to 900-MHz band) and a high-frequency band (mainly the 1.7- to 2.7-GHz band).

Tenth Embodiment

Figure 52:
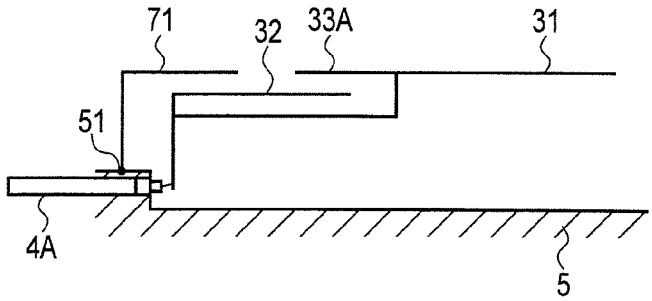
FIG. 52 is a view showing the arrangement of an antenna apparatus (monopole type) according to the tenth embodiment.

FIG. 52 is a view showing the arrangement of an antenna apparatus (in which the first antenna element 31 is formed from a monopole element) according to the tenth embodiment. Note that the same reference numbers as in FIG. 52 denote the same parts in FIG. 40, and a detailed description of them will be omitted.

Referring to FIG. 52, a side of a ground pattern 5 is formed into a stepped shape, and one end of a parasitic element 71 is connected to a ground terminal 53 provided on the stepped portion. A feed terminal 4 is provided on the vertical portion of the stepped side of the ground pattern 5. A feed cable 4A is wired along the stepped side of the ground pattern 5. The feed cable 4A is connected to the feed terminal 4.

This arrangement allows to linearly wire the feed cable 4A without folding it, thus preventing a deterioration in antenna characteristics due to variations in the wiring route of the feed cable 4A and the like.

Eleventh Embodiment

Figure 53:
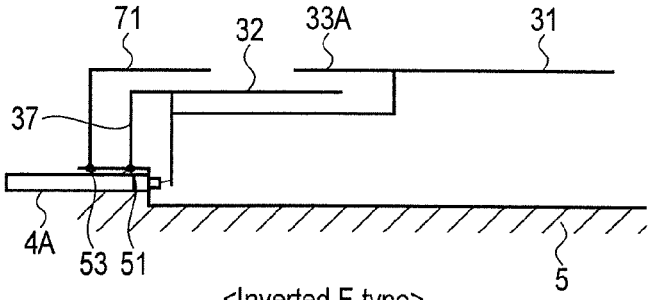
FIG. 53 is a view showing the arrangement of an antenna apparatus (inverted F type) according to the eleventh embodiment.

FIG. 53 shows the arrangement of an antenna apparatus (in which a first antenna element 31 is formed from an inverted F-type element) according to the eleventh embodiment. Note that the same reference numbers as in FIG. 53 denote the same parts in FIG. 43, and a detailed description of them will be omitted.

Referring to FIG. 53, a side of a ground pattern 5 is formed into a stepped shape as in the tenth embodiment. Ground terminals 51 and 53 are provided on the stepped portion of a side of the ground pattern 5. One end of a shorting element 37 and one end of a parasitic element 71 are respectively connected to the ground terminals 51 and 53. A feed terminal 4 is provided on the vertical portion of the side of the ground pattern 5 which is formed into the stepped shape. A feed cable 4A is wired along the stepped portion of the side of the ground pattern 5 and is connected to the feed terminal 4.

This arrangement allows to linearly wire the feed cable 4A without folding it, thus preventing a deterioration in antenna characteristics due to variations in the wiring route of the feed cable 4A and the like.

Twelfth Embodiment

Figure 54:
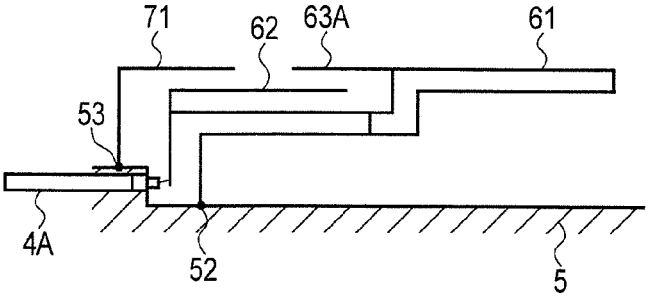
FIG. 54 is a view showing the arrangement of an antenna apparatus (folded type) according to the twelfth embodiment.

FIG. 54 shows the arrangement of an antenna apparatus (in which a first antenna element 61 is formed from a folded monopole element with a stub) according to the twelfth embodiment. Note that the same reference numbers as in FIG. 54 denote the same parts in FIG. 46, and a detailed description of them will be omitted.

Referring to FIG. 54, a side of a ground pattern 5 is formed into a stepped shape as in the tenth and eleventh embodiments. A ground terminal 53 is provided on the stepped portion of the side of the ground pattern 5. One end of a parasitic element 71 is connected to the ground terminal 53. A feed terminal 4 is provided on the vertical portion of the side of the ground pattern 5 which is formed into the stepped shape. A feed cable 4A is wired along the stepped portion of the side of the ground pattern 5. The feed cable 4A is connected to the feed terminal 4.

This arrangement allows to linearly wire the feed cable 4A without folding it, thus preventing a deterioration in antenna characteristics due to variations in the wiring route of the feed cable 4A and the like as in the tenth and eleventh embodiments.

Other Embodiments (1) Modifications of First Antenna Element 31

FIGS. 55A, 55B, 55C, 55D, 55E, and 55F show various modifications of the first antenna element 31.

Figure 55A:
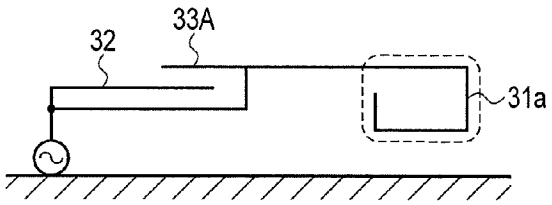
FIGS. 55A, 55B, 55C, 55D, 55E, and 55F are views showing a plurality of different modifications of the first antenna element of the antenna apparatus shown in FIG. 1.

The antenna apparatus shown in FIG. 55A is configured such that a portion of the first antenna element 31 which is located near the open end is folded as indicated by reference number 31*a* in FIG. 55A.

Figure 55B:
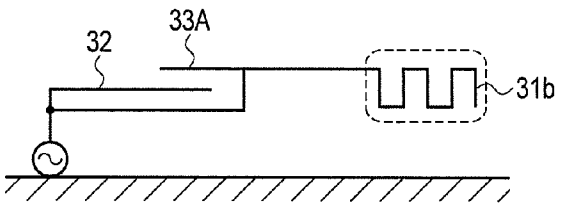

The antenna apparatus shown in FIG. 55B is configured such that a portion of the first antenna element 31 which is located near the open end is formed into a meander shape as indicated by reference number 31*b* in FIG. 55B.

The arrangement shown in FIG. 55A or 55B can reduce the installation space in the lengthwise direction of the elements of the antenna apparatus even if the element length of the first antenna element 31 is large.

Figure 55C:
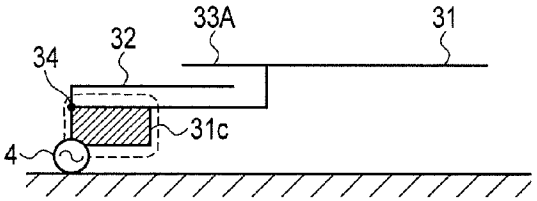
Figure 55D:
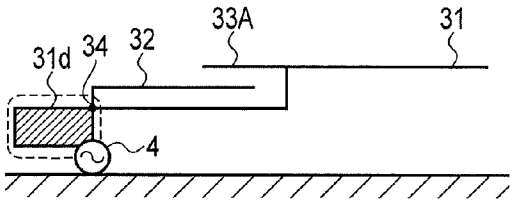

The antenna apparatuses shown in FIGS. 55C and 55D are configured such that portions 31*c* and 31*d* of the first antenna elements 31 which are located near the feed terminals 4 are formed wide.

Figure 55E:
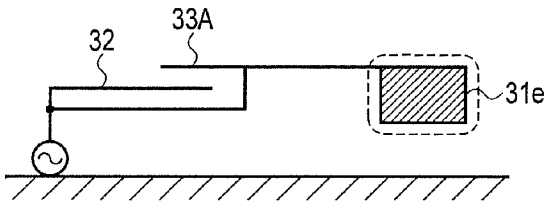

The antenna apparatus shown in FIG. 55E is configured such that a portion 31*e* of the first antenna element 31 which is located near the open end is formed wide.

Figure 55F:
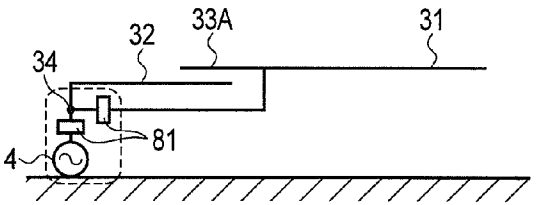

The antenna apparatus shown in FIG. 55F is configured such that lumped parameter elements 81 are respectively connected between the feed terminal 4 of the first antenna element 31 and the parallel connection point 34 and between the parallel connection point 34 and the branching point 35.

(2) Modifications of Second Antenna Element 32

FIGS. 56A, 56B, 56C, 56D, 56E, 56F, 56G, 56H, 56I, 56J, 56K, 56L, 56M, 56N, and 56O show various modifications of the second antenna element 32.

Figure 56A:
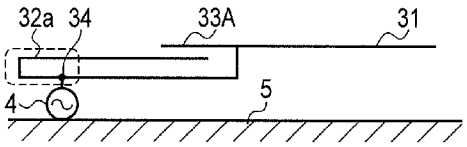

The antenna apparatus shown in FIG. 56A is configured such that one end of the second antenna element 32 is connected to the parallel connection point 34 of the first antenna element 31 in a direction opposite to the folding direction of the first antenna element 31, and the intermediate portion is folded, as indicated by reference number 32*a* in FIG. 56A.

Figure 56B:
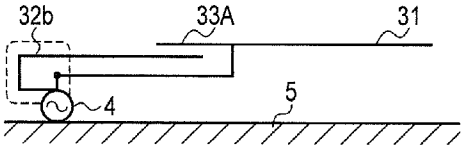

The antenna apparatus shown in FIG. 56B is configured such that one end of the second antenna element 32 is directly connected to the feed terminal 4, and an intermediate portion is folded, as indicated by reference number 32*b* in FIG. 56B.

Figure 56C:
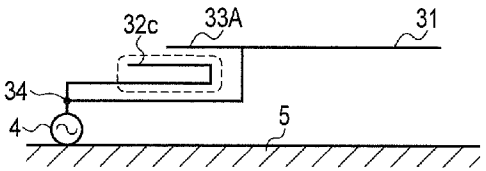

The antenna apparatus shown in FIG. 56C is configured such that an open end portion of the second antenna element 32 is folded at an intermediate position.

Figure 56D:
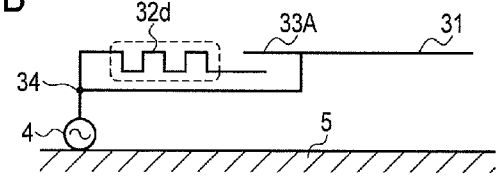

The antenna apparatus shown in FIG. 56D is configured such that an intermediate portion of the second antenna element 32 is formed into a meander shape, as indicated by reference number 32*d* in FIG. 56D.

Figure 56E:
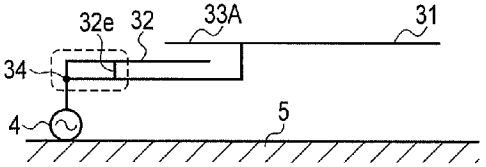

The antenna apparatus shown in FIG. 56E is configured such that an intermediate position of the second antenna element 32 is connected to an intermediate position of the first antenna element 31 through a shorting element 32*e*.

Figure 56F:
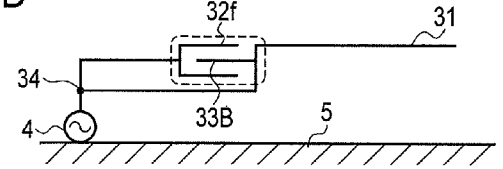
Figure 56G:
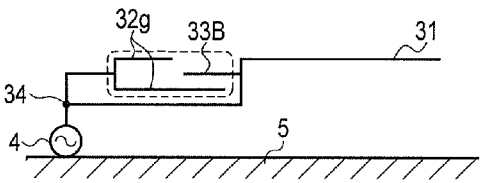

The antenna apparatuses shown in FIGS. 56F and 56G each are configured such that a section extending from an intermediate portion of the second antenna element 32 to the open end is made to branch into two elements, and both or one of the two elements are disposed to face the branch element 33B, as indicated by reference number 32*f* or 32*g* in FIG. 56F or 56G.

The antenna apparatuses shown in FIGS. 56H and 56I each are configured such that at least one (one in FIG. 56H or 56I) element 32*h* or 32*i* is connected in parallel to the second antenna element 32.

The antenna apparatuses shown in FIGS. 56J and 56K each are configured such that a portion near the connection point between the second antenna element 32 and the first antenna element 31 is formed into a wide plate-like shape, as indicated by reference number 32*j* or 32*k* in FIG. 56J or 56K.

The antenna apparatus shown in FIG. 56L is configured such that a portion extending from the proximal end of the second antenna element 32 to an intermediate position is formed into a wide plate-like shape, as indicated by reference number 32*l* in FIG. 56L.

The antenna apparatus shown in FIG. 56M is configured such that the lumped parameter element 81 is connected in an element of the second antenna element 32.

The antenna apparatus shown in FIG. 56N is configured such that the second antenna element 32 is disposed between the first antenna element 31 and the ground pattern 5, and a branch element 33*n* is disposed between the first antenna element 31 and the second antenna element 32.

The antenna apparatus shown in FIG. 56O is configured such that the second antenna element 32 is disposed between the first antenna element 31 and the ground pattern 5, and the branch element 33*n* is disposed between the second antenna element 32 and the ground pattern 5.

(3) Modifications of Branch Element 33

FIGS. 57A, 57B, 57C, 57D, and 57E show various modifications of the branch element 33.

Figure 57A:
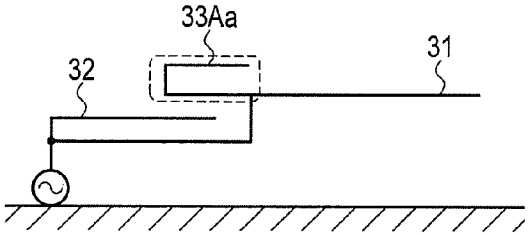
FIGS. 57A, 57B, 57C, 57D, and 57E are views showing a plurality of different modifications of the branch element of the antenna apparatus shown in FIG. 1.

The antenna apparatus shown in FIG. 57A is configured such that the branch element 33A is folded at its intermediate position, as indicated by reference number 33Aa in FIG. 57A.

Figure 57B:
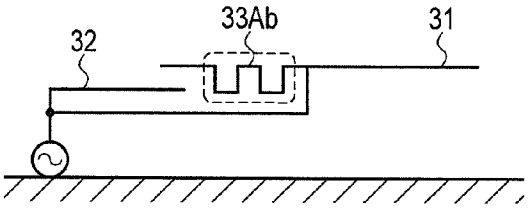

The antenna apparatus shown in FIG. 57B is configured such that an intermediate portion of the branch element 33A is formed into a meander shape, as indicated by reference number 33Ab in FIG. 57B.

Figure 57C:
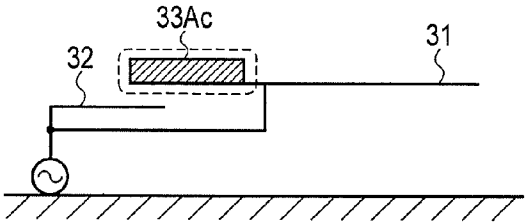

The antenna apparatus shown in FIG. 57C is configured such that a section extending from an intermediate position of the branch element 33A to the distal end is formed into a wide plate-like shape, as indicated by reference number 33Ac in FIG. 57C.

Figure 57D:
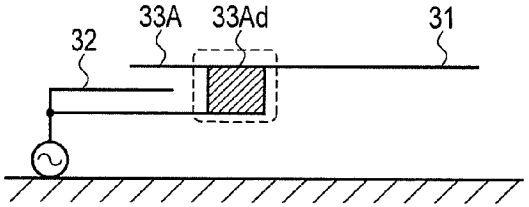

The antenna apparatus shown in FIG. 57D is configured such that a connection portion of the branch element 33A with respect to the first antenna element 31 is formed wide, as indicated by reference number 33Ad in FIG. 57D.

Figure 57E:
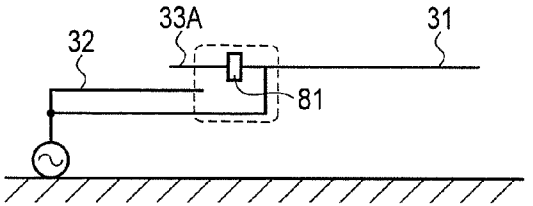

The antenna apparatus shown in FIG. 57E is configured such that the lumped parameter element 81 is connected in an element of the branch element 33A.

(4) Modifications of Inverted F-Type Antenna Element

FIGS. 58A, 58B, 58C, 58D, 58E, 58F, and 58G show various modifications of the inverted F-type antenna element.

Figure 58B:
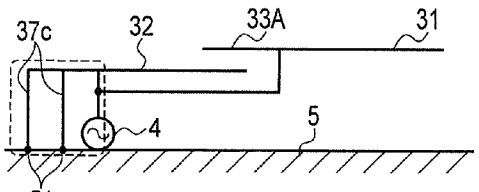
FIGS. 58A, 58B, 58C, 58D, 58E, 58F, and 58G are views showing a plurality of different modifications of the shorting element of the antenna apparatus shown in FIG. 15.
Figure 58D:
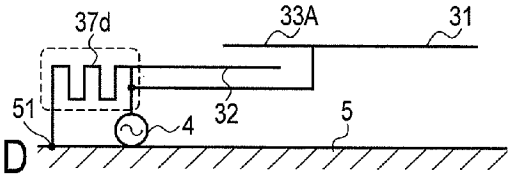
Figure 58F:
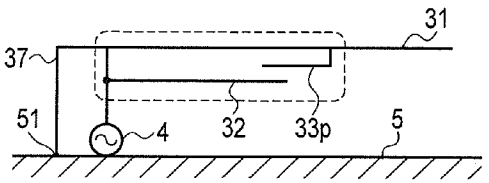
Figure 58A:
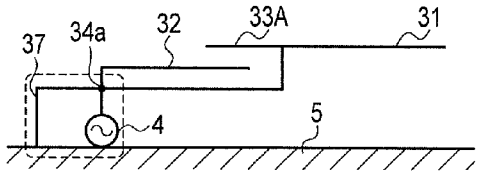

The antenna apparatus shown in FIG. 58A is configured such that a shorting element 71 is connected between the ground terminal 53 and a parallel connection point 34*a* between the first antenna element 31 and the second antenna element 32.

The antenna apparatus shown in FIG. 58B is configured such that a plurality of (two in FIG. 58B) shorting elements 71*a* and 71*b* are connected in parallel to the first antenna element 31.

Figure 58C:
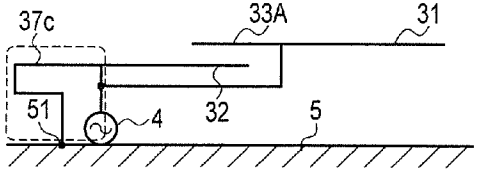

The antenna apparatus shown in FIG. 58C is configured such that the shorting element 71 is folded, as indicated by reference number 71*c* in FIG. 58C.

The antenna apparatus shown in FIG. 58D is configured such that an intermediate portion of the shorting element 71 is formed into a meander shape, as indicated by reference number 71*d* in FIG. 58D.

Figure 58E:
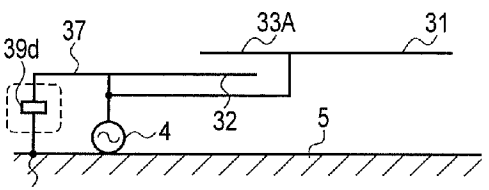

The antenna apparatus shown in FIG. 58E is configured such that the lumped parameter element 81 is connected in an element of the shorting element 71.

The antenna apparatus shown in FIG. 58F is configured such that the second antenna element 32 is disposed between the first antenna element 31 and the ground pattern 5, and a branch element 33*p* is disposed between the first antenna element 31 and the second antenna element 32.

Figure 58G:
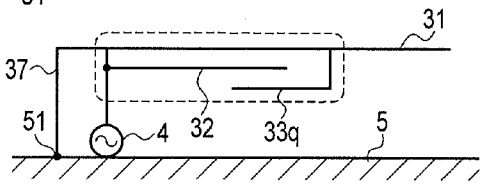

The antenna apparatus shown in FIG. 58G is configured such that the second antenna element 32 is disposed between the first antenna element 31 and the ground pattern 5, and a branch element 33*q* is disposed between the second antenna element 32 and the ground pattern 5.

(5) Modifications of Folded Antenna Element

FIGS. 59A, 59B, 59C, 59D, 59E, 59F, 59G, 59H, –59I, 59J, 59K, and 59L show various modifications of the first antenna element 61 formed from the folded monopole element with the stub.

Figure 59A:
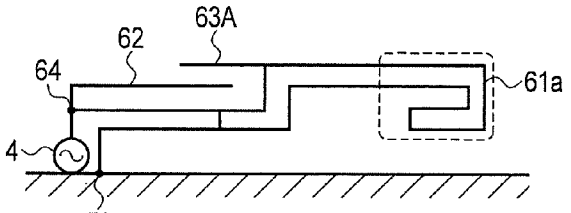
FIGS. 59A, 59B, 59C, 59D, 59E, 59F, 59G, 59H, 59I, 59J, 59K, and 59L are views showing a plurality of different modifications of the folded element of the antenna apparatus shown in FIG. 27.

The antenna apparatus shown in FIG. 59A is configured such that the distal end portion of the first antenna element 61 is folded, as indicated by reference number 61*a* in FIG. 59A.

Figure 59B:
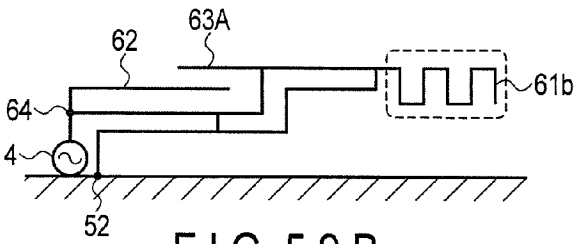

The antenna apparatus shown in FIG. 59B is configured such that the distal end portion of the first antenna element 61 is formed from one element and formed into a meander shape, as indicated by reference number 61*b* in FIG. 59B.

Figure 59C:
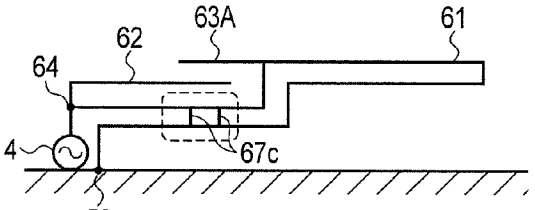

The antenna apparatus shown in FIG. 59C is configured such that a plurality of stubs 67*c* are provided at intermediate positions of the first antenna element 61.

Figure 59D:
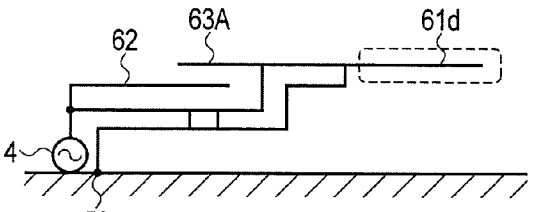

The antenna apparatus shown in FIG. 59D is configured such that the distal end portion of the first antenna element 61 is formed from one element, as indicated by reference number 61*d* in FIG. 59D.

Figure 59E:
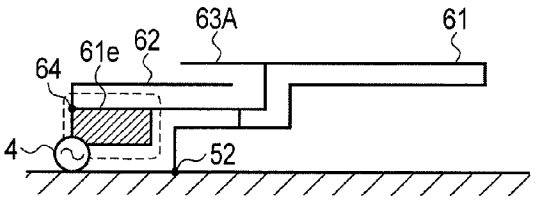
Figure 59F:
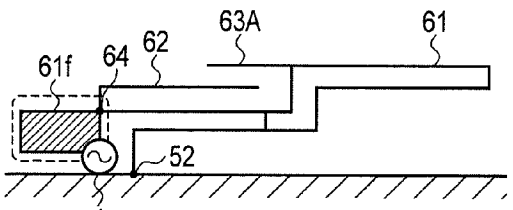

The antenna apparatuses shown in FIGS. 59E and 59F each are configured such that a portion of the first antenna element 61 which is located near the feed terminal 4 is formed into a wide plate-like shape, as indicated by reference number 61 in FIG. 59E or 59F.

Figure 59H:
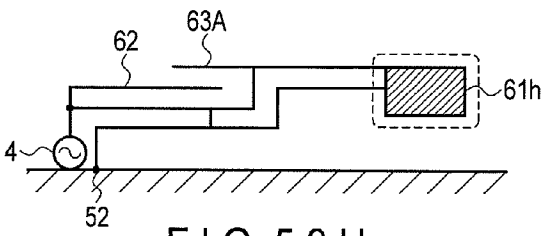
Figure 59J:
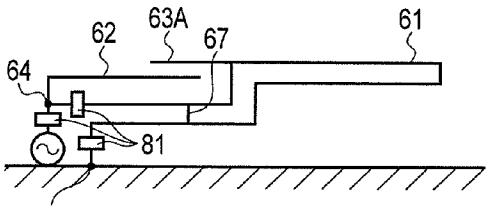
Figure 59L:
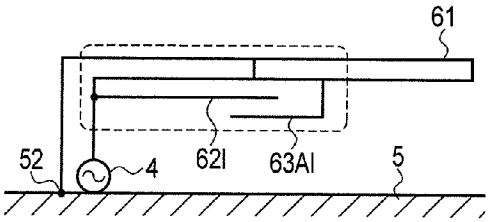
Figure 59G:
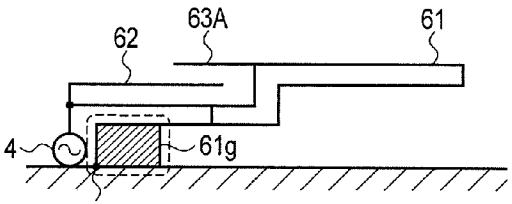

The antenna apparatus shown in FIG. 59G is configured such that a portion of the first antenna element 61 which is located near the ground terminal is formed into a wide plate-like shape, as indicated by reference number 61*g* in FIG. 59G.

The antenna apparatus shown in FIG. 59H is configured such that the distal end portion of the first antenna element 61 is formed into a wide plate-like portion 61*h*.

Figure 59I:
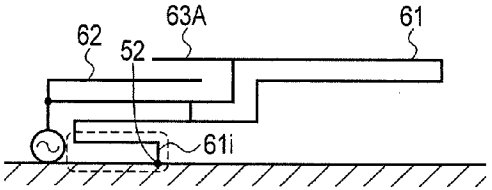

The antenna apparatus shown in FIG. 59I is configured such that the other end portion of the first antenna element 61 is folded into a crank shape, and its distal end is connected to the ground terminal 52 provided at a position spaced away from the feed terminal 4. That is, the ground point of the folded monopole element 61 with the stub with respect to the ground pattern 5 is offset.

The antenna apparatus shown in FIG. 59J is configured such that the lumped parameter elements 81 are respectively connected between the parallel connection point 64 and the feed terminal 4 of the first antenna element 61, between the parallel connection point 64 and a branching point 65, and between the connection position of the stub 67 and the ground terminal 52.

Figure 59K:
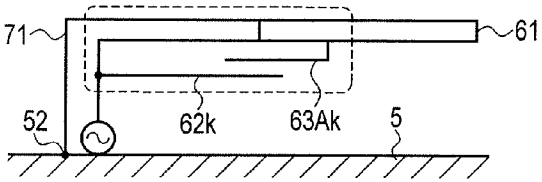

The antenna apparatus shown in FIG. 59K is configured such that a second antenna element 62*k* is disposed between the first antenna element 61 and the ground pattern 5, and a branch element 63Ak is disposed between the first antenna element 61 and the second antenna element 62*k*.

The antenna apparatus shown in FIG. 59L is configured such that a second antenna element 62*l* is disposed between the first antenna element 61 and the ground pattern 5, and a branch element 63Al is disposed between the second antenna element 62*l* and the ground pattern 5.

(6) Other Modifications

Figure 60B:
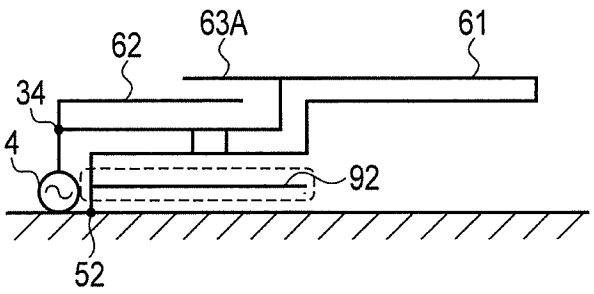
FIGS. 60A and 60B are views showing other modifications of the antenna apparatuses shown in FIGS. 1 and 27.
Figure 60A:
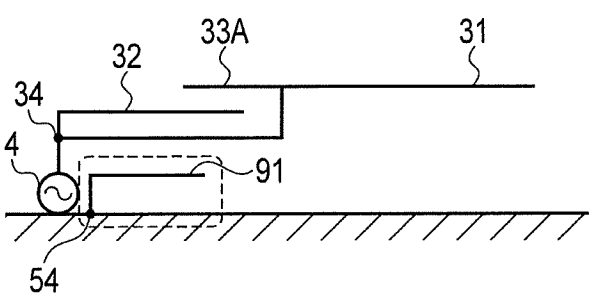

The antenna apparatus shown in FIG. 60A is configured such that a parasitic element 91 is disposed between the first antenna element 31 and the ground pattern 5. The parasitic element 91 is directly connected to a ground terminal 54 provided on the ground pattern 5.

The antenna apparatus shown in FIG. 60B is configured such that a parasitic element 92 is disposed between the ground pattern 5 and the first antenna element 61 formed from the folded element. The proximal end of the parasitic element 92 is connected to a portion of the first antenna element which is located near the ground terminal 52.

The embodiments can be executed by variously modifying the shapes, installation positions, and sizes of a folded monopole element with a stub, monopole element, and parasitic element and the types, arrangements, and the like of electronic devices.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna apparatus connected to a feed terminal, the apparatus comprising:

a first antenna element including a first end connected to the feed terminal, and a second end open, the first antenna element including a first section, a second section and a third section, the first section being from the first end to a first point, the second section being from the first point to a second point, and the third section being from the second point to the second end, and an element length from the feed terminal to the second end being substantially ¼ of a wavelength corresponding to a first frequency;

a second antenna element including a first end connected to the first point on the first antenna element, and a second end open, at least part of the second antenna element being parallel to at least part of the first antenna element, an element length from the feed terminal to the second end of the second antenna element being substantially ¼ of a wavelength corresponding to a second frequency; and a third antenna element including a first end connected to the second point on the first antenna element, and a second end open, one of the second antenna element and the third antenna element being located between the first antenna element and an other one of the second antenna element and the third antenna element.

2. The apparatus of claim 1, further comprising a shorting element including a first end connected to a third position on one of the first antenna element and the second antenna element, and a second end connected to a first ground terminal, at least part of the shorting element being parallel to one of the first antenna element and the second antenna element.

3. The apparatus of claim 1, wherein the first frequency is lower than the second frequency.

4. The apparatus of claim 1, further comprising a fourth antenna element comprising a parasitic element including a first end connected to a second ground terminal, and a second end open, at least part of the parasitic element being parallel to the second antenna element so as to be capacitively coupled to the second antenna element.

5. The apparatus of claim 4, further comprising:

a printed circuit board including a first area where conductive patterns of the first antenna element, the second antenna element, the third antenna element, the fourth antenna element and the feed terminal are formed, and a second area where the ground pattern, the first ground terminal, and the second ground terminal are formed wherein the ground pattern includes a part of a side formed into a substantially crank shape; and a feed cable with a distal end portion of a conductive line being on the second area so as to protrude from the side formed into the crank shape to the first area, and the distal end portion of the conductive line being connected to the feed terminal formed in the first area.

6. The antenna apparatus of claim 1, wherein the second antenna element receives a first current flow from the feeding terminal through the first antenna element and the third antenna element receives a second current flow from the feeding terminal through the first antenna element.

7. The antenna apparatus of claim 1, wherein the one of the second antenna element and the third antenna element is the second antenna element and the other one of the second antenna element and the third antenna element is the third antenna element.

8. An antenna apparatus connected to a feed terminal and a first ground terminal on a ground pattern, the apparatus comprising:

a first antenna element comprising a folded monopole element including a first end connected to the feed terminal, and a second end connected to the first ground terminal, the first antenna element including a first section, a second section, a third section and a stub, the first section being from the first end to a first point, a second section being from the first point to a second point, the third section being from the second point to the second end and the stub being between a portion of the second section and a portion of the third section of the first antenna element, an electrical length from the feed terminal to the first ground terminal being substantially ½ of a wavelength corresponding to a first frequency;

a second antenna element including a first end connected to the first point on the first antenna element and a second end open, at least part of the second antenna element being parallel to at least part of the first antenna element, an element length from the feed terminal to the second end of the second antenna element being substantially ¼ of a wavelength corresponding to a second frequency; and a third antenna element including a first end connected to the second point on the first antenna element, and a second end open, one of the second antenna element and the third antenna element being located between the first antenna element and an other one of the second antenna element and the third antenna element.

9. The apparatus of claim 8, wherein the first frequency is lower than the second frequency.

10. The apparatus of claim 8, wherein a distance between the feed terminal and the first ground terminal is substantially not more than ⅕ of a wavelength corresponding to the first frequency.

11. The apparatus of claim 8, wherein a section from an installation position of the stub on the second section of the first antenna element to a folding end is formed from one linear element or a plate-like element.

12. The apparatus of claim 8, further comprising a fourth antenna element comprising a parasitic element including a first end connected to a second ground terminal on the ground pattern, and a second end open, at least part of the parasitic element being parallel to the second antenna element so as to be capacitively coupled to the second antenna element.

13. The apparatus of claim 12, further comprising:

a printed circuit board including a first area where conductive patterns of the first antenna element, the second antenna element, the third antenna element, the fourth antenna element and the feed terminal are formed, and a second area where the ground pattern, the first ground terminal, and the second ground terminal are formed wherein the ground pattern includes a part of a side formed into a substantially crank shape; and a feed cable with a distal end portion of a conductive line being on the second area so as to protrude from the side formed into the crank shape to the first area, and the protruding distal end portion of the conductive line being connected to the feed terminal formed in the first area.

14. The antenna apparatus of claim 8, wherein the second antenna element receives a first current flow from the feeding terminal through the first antenna element and the third antenna element receives a second current flow from the feeding terminal through the first antenna element.

15. The antenna apparatus of claim 8, wherein the one of the second antenna element and the third antenna element is the second antenna element and the other one of the second antenna element and the third antenna element is the third antenna element.

16. An electronic device comprising:

a radio unit configured to transmit and receive a radio signal; and an antenna apparatus connected to the radio unit via a feed terminal, the antenna apparatus comprising a first antenna element including a first end connected to the feed terminal, and a second end open, the first antenna element including a first section, a second section and a third section, the first section being from the first end to a first point, the second section being from the first point to a second point, and the third section being from the second point to the second end, and an element length from the feed terminal to the second end being substantially ¼ of a wavelength corresponding to a first frequency, a second antenna element including a first end connected to the first point on of the first antenna element, and a second end open, at least part of the second antenna element being parallel to at least part of the first antenna element, an element length from the feed terminal to the second end of the second antenna element being substantially ¼ of a wavelength corresponding to a second frequency, and a third antenna element including a first end connected to the second point on the first antenna element, and a second end open, one of the second antenna element and the third antenna element being located between the first antenna element and an other one of the second antenna element and the third antenna element.

17. The device of claim 16, wherein the antenna apparatus further comprises a shorting element including a first end connected to a third position on one of the first antenna element and the second antenna element, and a second end connected to a first ground terminal, at least part of the shorting element being parallel to one of the first antenna element and the second antenna element.

18. The electronic device of claim 16, wherein the second antenna element receives a first current flow from the feeding terminal through the first antenna element and the third antenna element receives a second current flow from the feeding terminal through the first antenna element.

19. An electronic device comprising:

a radio unit configured to transmit and receive a radio signal; and an antenna apparatus connected to the radio unit via a feed terminal and a first ground terminal, the antenna apparatus comprising a first antenna element comprising a folded monopole element including a first end connected to the feed terminal, and a second end connected to the first ground terminal, the first antenna element including a first section, a second section, a third section and a stub, the first section being from the first end to a first point, a second section being from the first point to a second point, the third section being from the second point to the second end and the stub being between a portion of the second section and a portion of the third section of the first antenna element, an electrical length from the feed terminal to the first ground terminal being substantially ½ of a wavelength corresponding to a first frequency, a second antenna element including a first end connected to the first position on the first antenna element, and a second end open, at least part of the second antenna element being parallel to at least part of the first antenna element, an element length from the feed terminal to the second end of the second antenna element being substantially ¼ of a wavelength corresponding to a second frequency, and a third antenna element including a first end connected to the second point on the first antenna element and a second end open, one of the second antenna element and the third antenna element being located between the first antenna element and an other one of the second antenna element and the third antenna element.

20. The electronic device of claim 19, wherein the second antenna element receives a first current flow from the feeding terminal through the first antenna element and the third antenna element receives a second current flow from the feeding terminal through the first antenna element.

* * * * *